US007324762B2

(12) United States Patent
Harumoto

(10) Patent No.: US 7,324,762 B2
(45) Date of Patent: Jan. 29, 2008

(54) CARTRIDGE, INDENTIFICATION INFORMATION TAG AND IMAGE FORMING DEVICE

(75) Inventor: Katsumi Harumoto, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 169 days.

(21) Appl. No.: 10/963,715

(22) Filed: Oct. 14, 2004

(65) Prior Publication Data

US 2005/0196180 A1 Sep. 8, 2005

(30) Foreign Application Priority Data

Mar. 8, 2004 (JP) ..... 2004-064337

(51) Int. Cl.
*G03G 15/00* (2006.01)

(52) U.S. Cl. ..... 399/12; 399/119

(58) Field of Classification Search ..... 399/119, 399/12, 111

See application file for complete search history.

(56) References Cited

U.S. PATENT DOCUMENTS 4,740,808 A * 4/1988 Kasamura et al. ..... 399/12
5,559,589 A * 9/1996 Eichberger et al. ..... 399/119
6,032,010 A * 2/2000 Kim et al. ..... 399/12
6,347,195 B1 * 2/2002 Saiki et al. ..... 399/12
6,349,182 B2 * 2/2002 Otsubo et al. ..... 399/12
6,366,742 B1 4/2002 Reihl et al.
6,549,731 B1 * 4/2003 Yoshida et al. ..... 399/12
2003/0184624 A1 * 10/2003 Kinalski

FOREIGN PATENT DOCUMENTS

CN 1207512 A 2/1999
CN 1320228 A 10/2001
JP 2001022230 A * 1/2001
JP 2003005589 A * 1/2003

* cited by examiner

*Primary Examiner*—Susan Lee
(74) *Attorney, Agent, or Firm*—Sughrue Mion, Pllc.

(57) ABSTRACT

A cartridge is detachably attached to an image forming device, and an identification information tag that stores identification information for distinguishing the cartridge from other cartridges therein is attached to the cartridge. An identification key is provided on the identification information tag and mechanically engages with the image forming device and distinguishes whether or not the cartridge can be attached. The identification information tag is characterized by the identification key mechanically engaging with the image forming device and distinguishing whether or not the cartridge can be attached. In an image forming device to which the cartridge is attached, when the cartridge is attached the attachment portion, the image forming device mechanically identifies whether or not the cartridge can be attached by using the identification key provided on the identification information tag attached to the cartridge.

20 Claims, 23 Drawing Sheets

CARTRIDGE, INDENTIFICATION INFORMATION TAG AND IMAGE FORMING DEVICE

CROSS-REFERENCE TO RELATED APPLICATION

This application claims priority under 35 USC 119 from Japanese Patent Application No. 2004-064337, the disclosure of which is incorporated by reference herein.

BACKGROUND OF THE INVENTION

1. Field of the Invention

The present invention relates to a cartridge, an identification information tag and an image forming device.

2. Description of the Related Art

In an image forming device such as a color printer or copying machine, it has become common to use a color toner cartridge that fills toner of yellow (Y), magenta (M), cyan (C) or black (K), respectively, therein for the convenience of supplying toner or to pack a photosensitive drum and peripheral components in a detachable central processing unit so as to serve the convenience of maintenance and repair.

In the image forming device using attached color toner cartridges, since attachment of the cartridge at a wrong position causes color mixture, each cartridge needs to be attached at only the respective predetermined position so as not to be attached at other positions.

Moreover, in the case of OEM (Original Equipment Manufacturing), cartridges including toner cartridge and central processing unit are generally manufactured for multiple destinations. In such cases, the cartridge for one destination is often prevented from being used for other destinations.

Further, to prevent troubles due to attachment and use of a non-genuine cartridge in the image forming device, the non-genuine cartridge often cannot be attached.

As a measure of meeting these demands, it has been conventionally carried out to provide a hard key such as various protrusion or recess portion on the surface of the cartridge so that only the cartridge having the hard key in a certain shape can be attached mechanically to the image forming device and the cartridge having the hard key in a different shape cannot be attached mechanically.

As a method of preventing the non-genuine cartridge from being mechanically attached to the image forming device, there has been proposed to form a protrusion or recess portion in the shape of logo mark on the surface abutting to a hopper portion of the toner cartridge and also form a corresponding protrusion or recess portion on the hopper portion at the position to which the protrusion or recess portion fits.

Since manufacturers of non-genuine products cannot use the logo mark, no protrusion or recess portion in the shape of logo mark is formed on the above-mentioned surface of the cartridge made by manufacturers of non-genuine products. Accordingly, when the toner cartridge made by manufacturers of non-genuine products is used as a spare part, the above-mentioned protrusion or recess portion needs to be formed on the above-mentioned surface, necessitating change in the shape of the above-mentioned surface. Thus, it is very difficult to use non-genuine products.

As another method of preventing use of the non-genuine cartridge, there has been proposed to provide a data carrier for holding predetermined data in a genuine change part, provide a data reading unit for reading the data in a main body of the device, determine whether or not the attached change part is a genuine one in advance, perform normal operation when it is a genuine one and stop normal operation or store the use state of non-genuine part in a memory when it is a non-genuine one.

However, when the hard key or the protrusion or recess portion in the shape of logo mark that varies with destinations is provided to the cartridge, in the case of many destinations, there is need to carry a large stock for every different hard key or logo mark. Further, provision of the hard key or logo mark that varies with destinations causes a lot of problems in terms of manufacturing management. Furthermore, it also generates a problem that the cartridge with the hard key or logo mark in a wrong shape may be shipped.

SUMMARY OF THE INVENTION

To solve the above-mentioned problems, the present invention intends to provide a cartridge, an identification information tag and an image informing device that can drastically reduce costs of manufacturing and stock as well as facilitate manufacturing and inventory control.

A first aspect for solving the problems is to provide a cartridge detachably attached to an image forming device, to which an identification information tag that stores identification information for distinguishing the cartridge from other cartridge therein is attached, wherein an identification key that mechanically engages with the image forming device and distinguishes whether or not the cartridge can be attached is provided on the identification information tag.

A second aspect for solving the problems is to provide an identification information tag that is attached to the cartridge detachably attached to the image informing device and stores identification information for distinguishing the cartridge from other cartridge therein, wherein the an identification key that mechanically engages with the image forming device and distinguishes whether or not the cartridge can be attached is provided.

A third aspect for solving the problems is to provide an image forming device to which the cartridge is attached, wherein when the cartridge is attached the cartridge attachment portion, the image forming device mechanically identifies whether or not the cartridge can be attached by using the identification key formed on the identification information tag attached to the cartridge.

BRIEF DESCRITION OF THE DRAWINGS

DESCRIPTION OF THE PREFERRED EMBODIMENTS

1. First Embodiment

A laser printer that is an example of the image forming device of this invention and a wireless communication system of the laser printer will be described below with reference to figures.

(Configuration of Laser Printer)

Figure 1:
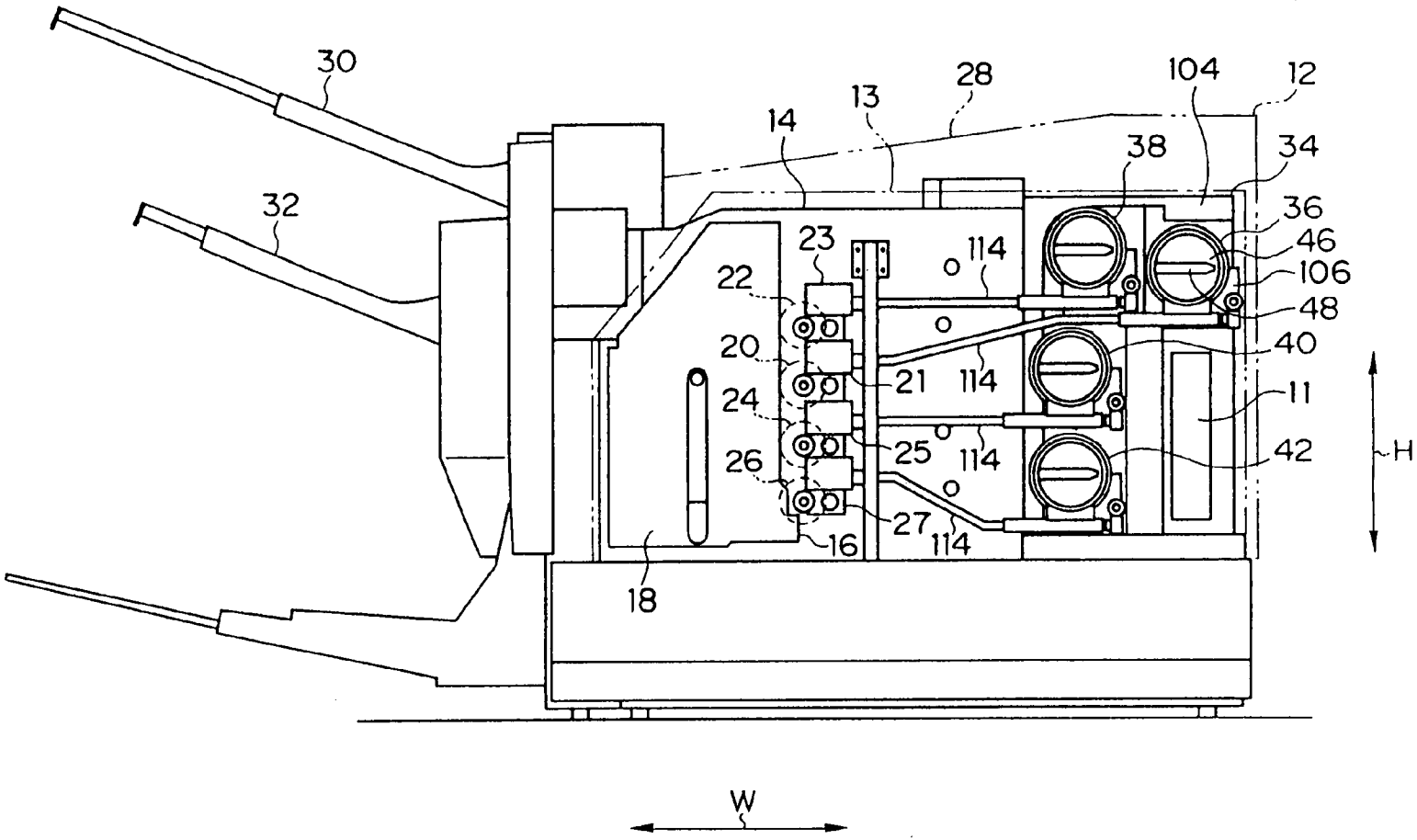
FIG. 1 is a schematic cross sectional view showing the overall configuration of a laser printer in accordance with a first embodiment.

FIG. 1 shows overall configuration of a laser printer 10 of a first embodiment.

By a publicly known electrophotograph process, the laser printer 10 forms a toner image in accordance with image information input from an external device, transfers and fixes the formed toner image on recording paper or the like to form an image. Here, electrophotograph process refers to a series of process of recording an image on a recording member by transferring the toner image formed on an electrophotograph photosensitive body through electrification to the electrophotograph photosensitive body, formation of an electrostatic latent image by laser exposure and development of the electrostatic latent image by toner, on the recording member and fixing the image by the application of heat. In the laser printer 10, a color image is formed by using the following four colors of toner: magenta (M), yellow (Y), black (K) and cyan (C).

As shown in FIG. 1, the laser printer 10 has a housing 12 that constitutes an outer shell of the device and a mainframe 14 that is provided within the housing 12 and supports various components constituting the device.

A process unit 16 is arranged at one end of the mainframe 14 along the width direction of the device (the direction of an arrow W) (left end in FIG. 1). The process unit 16 is provided with a slide frame 18 slidably supported by the mainframe 14 along the depth direction of the device, and predetermined process components (not shown) including an intermediate transfer belt, a transcriber and a cleaning device are mounted on the slide frame 18. Accordingly, at the time of maintenance, replacement and inspection of the process components mounted on the slide frame 18 can be easily made by drawing the process unit 16 out of the mainframe 14.

In the mainframe 14, four photosensitive drums 20, 22, 24 and 26 are supported so as to be adjacent to the process unit 16 and four developing units 21, 23, 25 and 27 are placed so as to be in contact with these photosensitive drums 20, 22, 24 and 26, respectively. Magenta (M) toner, yellow (Y) toner, black (K) toner and cyan (C) toner, respectively, are supplied to the corresponding four developing units 21, 23, 25 and 27 and adhered to electrostatic latent images formed on peripheral faces (image carrying faces) of the photosensitive drums 20, 22, 24 and 26 for development to form toner images. Hereinafter, magenta (M) toner, yellow (Y) toner, black (K) toner and cyan (C) toner are abbreviated to M toner, Y toner, K toner and C toner, respectively.

The toner images formed on the photosensitive drums 20, 22, 24 and 26 are transferred and superimposed on the intermediate transfer belt arranged at the side of the process unit 16 to form a full-color toner image. The full-color toner image is transferred from the intermediate transfer belt to the recording member such as a recording paper, fixed by the application of heat and recorded on the recording member.

The recording member on which the toner image is recorded is delivered to a delivery tray 28 formed on the top face of the housing 12 or delivery trays 30 and 32 attached to the side face of the housing 12 so as to extend sideward.

In addition, the laser printer 10 can be also set so as to form a monochrome toner image by using only K toner, transfer and fix it on the recording member to form a monochrome image.

Figure 2:
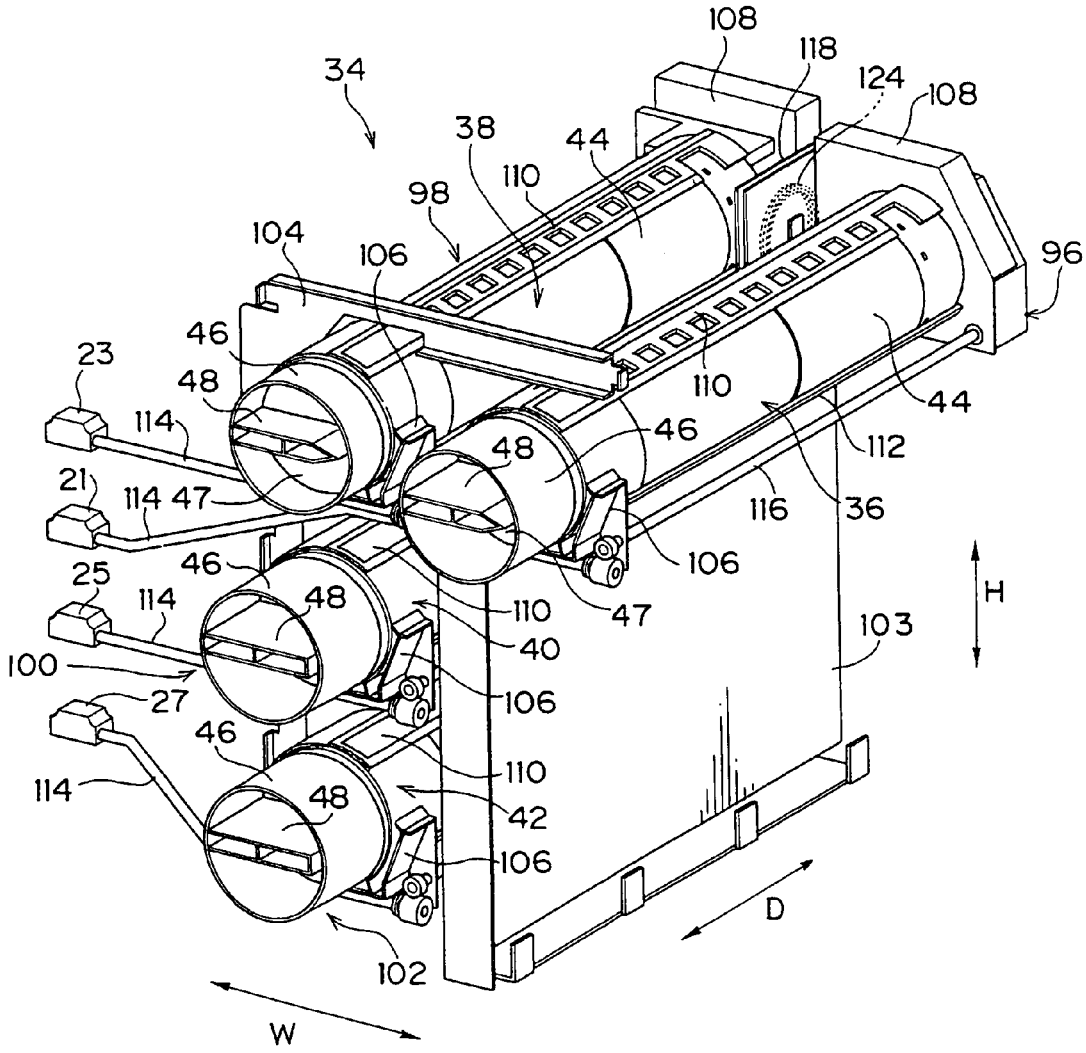
FIG. 2 is a perspective view showing the configuration of a cartridge holder of the laser printer shown in FIG. 1 when viewed from above at an oblique angle.

In the laser printer 10, with a cartridge holder 34 is provided so as to be adjacent to the mainframe 14 along the width direction. The cartridge holder 34 corresponds to a toner cartridge detachment portion of the image forming device according to the invention. As shown in FIG. 2, four toner cartridges 36, 38, 40 and 42 formed in a subcolumnar form are inserted to the cartridge holder 34 detachably. The toner cartridges 36, 38, 40 and 42 each stores M toner, Y toner, K toner and C toner, respectively, therein.

As shown in FIG. 1, the housing 12 is provided with an openable open-close door 13 for maintenance at one side face (near side in FIG. 1), as opposed to the process unit 16 and the cartridge holder 34. Thus, the user can open the open-close door 13 and expose the process unit 16 and the cartridge holder 34 to the outside, thereby to draw the process unit 16 out of the mainframe 14 or detach the toner cartridges 36, 38, 40 and 42 separately from the cartridge holder 34.

As shown in FIG. 2, in the cartridge holder 34, detachment portions 96, 98, 100 and 102, to which the toner cartridges 36, 38, 40 and 42 are detachably attached, are provided in two rows in the height direction H of the device (the direction of an arrow H), that is, in the vertical direction. Three detachment portions 98, 100 and 102 are placed in a first row at the side closer to the developing unit 21, 23, 25 and 27 and remaining one detachment portion 96 is placed in a second row at the side further to developing unit 21, 23, 25 and 27.

Therefore, as shown in FIGS. 1 and 2, since four toner cartridges 36, 38, 40 and 42 attached to the cartridge holder 34 is arranged in the reversed-L shape when viewed from outside in the axial direction, the length in the height direction H of the device becomes smaller than that in the case where the toner cartridges 36, 38, 40 and 42 are arranged linearly in the height direction H.

In the space surrounded by the detachment portions 96, 98, 100 and 102 arranged in the reversed-L shape, in other words, the space surrounded by the toner cartridges 36, 38, 40 and 42 contains an electronic circuit 11 for controlling the laser printer 10. Due to containment in the above-mentioned space, the electronic circuit 11 is effectively protected from toner cloud generated in the developing unit 21, 23, 25 and 27.

Further, since monochrome printing is generally performed much more often than full-color printing in the laser printer 10, K toner is supposedly most consumed. Therefore, when the toner cartridge 40 containing K toner in place of the toner cartridge 36 containing M toner is placed in the second row and the toner cartridge 36 is placed at the center of the first row and the toner cartridge 40 is made bigger than the toner cartridges 36, 38 and 42, replacement cycle of the toner cartridges 36, 38, 40 and 42 can be extended preferably without enlarging the laser printer 10.

Figure 3:
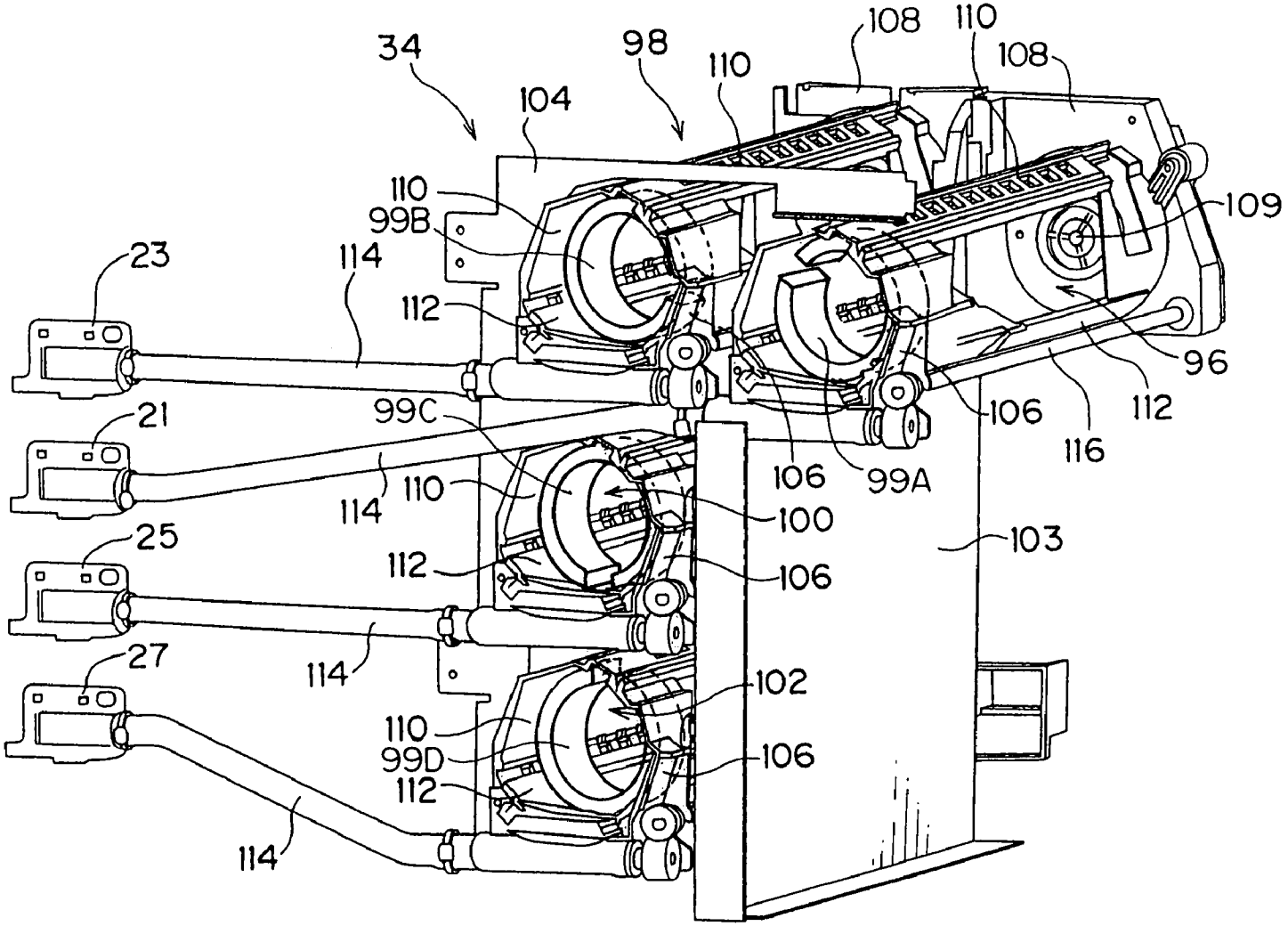
FIG. 3 is a perspective view showing the cartridge holder shown in FIG. 2 from which toner cartridges are detached when viewed from front at an oblique angle.
Figure 4:
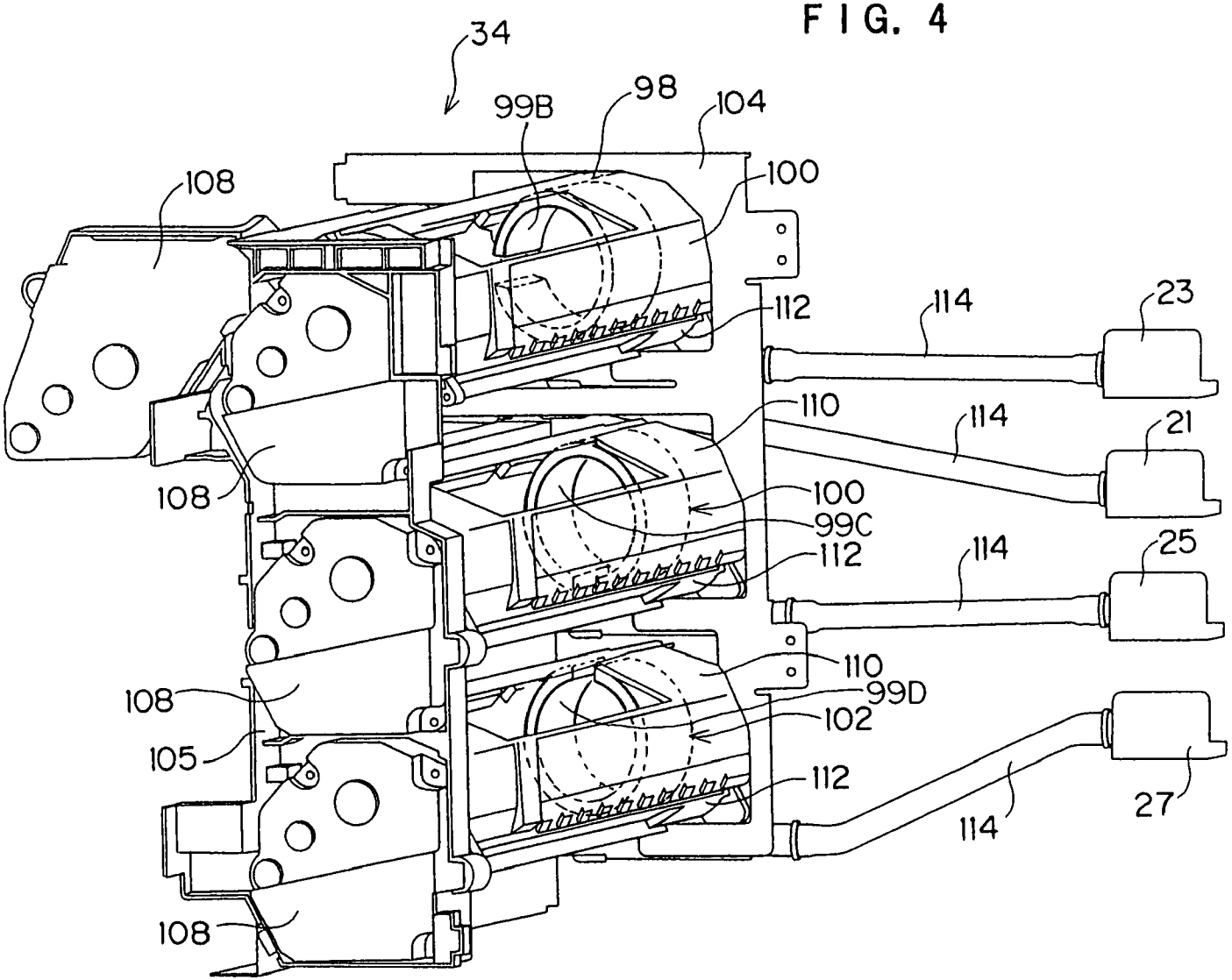
FIG. 4 is a perspective view showing the cartridge holder shown in FIG. 2, from which toner cartridges are detached, when viewed from rear at an oblique angle.

As shown in FIGS. 2 to 4, the detachment portions 96, 98, 100 and 102 are formed so as to have the same size as each other in the axial direction, and their fore ends are supported by a foreside supporting plate 104 that extends so as to surround the toner cartridges 36, 38, 40 and 42 in the reversed-L shape at the fore end of the cartridge holder 34 and their rear ends are supported by a backside supporting plate 105 formed so as to be opposed to the foreside support plate 104 at the rear end of the cartridge holder 34.

The foreside support plate 104 and the backside supporting plate 105 are connected to each other with a connecting plate 103 that extends in the vertical direction. The connecting plate 103 also functions so as to divide the cartridge holder 34 from the space containing the electronic circuit 11 therein.

The detachment portions 96, 100 and 102 are disposed at the same position along the axial direction, that is, at the same position along the depth direction D of the laser printer 10 and only the detachment portion 98 is disposed at the position protruding from the front edges of other detachment portions 96, 100 and 102 along the depth direction D of the laser printer 10. By disposing the detachment portions 96, 98, 100 and 102 in this manner, toner feeding tubes 114 provided at the detachment portions 98 and 96 can be prevented from interfering with each other.

As shown in FIGS. 2 to 4, each of the detachment portions 96, 98, 100 and 102 is constituted by a supporting bracket 106, a driving plate 108 disposed opposed to the supporting bracket 106, and two guide members 110 and 112 that bridge between the driving plate 108 and the supporting bracket 106 along the depth direction D. Each of the detachment portions 96, 98, 100 and 102 is supported at the supporting bracket 106 by the foreside supporting plate 104 and at the driving plate 108 by the backside supporting plate 105. When the toner cartridges 36, 38, 40 and 42 are inserted or detached into or from the cartridge holder 34, they are guided by the guide members 110 and 112 so as to move linearly in the depth direction.

Figure 5:
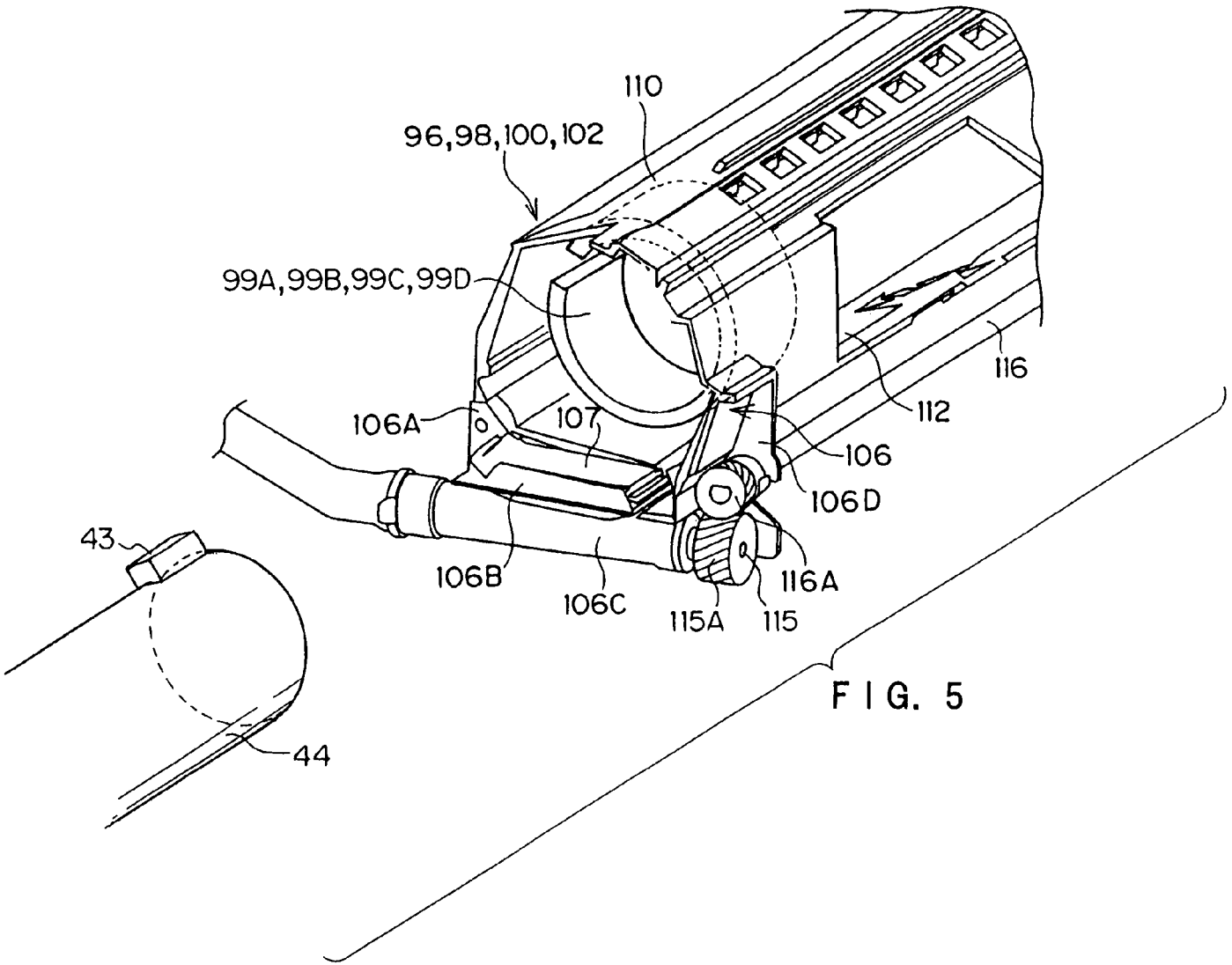
FIG. 5 is an enlarged perspective view showing the configuration of an inlet of a detaching part of the cartridge holder shown in FIG. 2.

As shown in FIG. 5, the supporting bracket 106 is formed of a fixing part 106A fixed to the foreside supporting plate 104, and a shutter supporting member 106B that abuts on the fixing part 106A and extends vertically with respect to the axis lines of the detachment portions 96, 98, 100 and 102, a cylindrical toner leading part 106C that abuts on the bottom of the shutter supporting member 106B and extends vertically with respect to the axis lines of the detachment portions 96, 98, 100 and 102, and a bearing plate 106D that is located at the opposite side of the fixing part 106A across the shutter supporting member 106B and pivotally supports a torque transmitting shaft 116 that is described later. The shutter supporting member 106B is recessed in the partial cylindrical shape and an engaging shutter 107 slides on the top surface of the shutter supporting member 106B. The shutter supporting member 106B is provided with an opening 106E that communicates to the toner leading part 106C. The engaging shutter 107 engages in the below-mentioned shutter member 56 of the toner cartridges 36, 38, 40 and 42 and opens and shuts together.

As shown in FIG. 4, the driving plate 108 is shaped like a thick plate and supported so as to match its thickness direction with the depth direction of the device. On the surface of the driving plate 108 as opposed to the bottom faces of the toner cartridges 36, 38, 40 and 42, a driving connecting plate 109 for engaging with and rotating a driven connecting plate 52 (refer to FIG. 6) is disposed rotatably. The shape of the driving connecting plate 109 corresponds to that of the driven connecting plate 52. The driving plate 108 stores a driving motor (not shown) therein and the driving motor rotates the driving connecting plate 109 by rotating during operation of the developing units 21, 23, 25 and 27. The driving plate 108 is further provided with the torque transmitting shaft 116. A bevel gear 116A is fitted to the end of the torque transmitting shaft 116 on the side of the supporting bracket 106.

As shown in FIGS. 1 to 4, each of the detachment portions 96, 98, 100 and 102 is provided with the toner feeding tube 114 for feeding toner to the developing unit 21, 23, 25 and 27, respectively. The toner feeding tube 114 is made of a flexible semitransparent or transparent tube, and connected to the toner leading part 106C of the supporting bracket 106 at one end and to the developing unit 21, 23, 25 and 27, respectively at the other end. A spiral auger (not shown) is disposed within the toner feeding tube 114. As shown in FIG. 5, a bevel gear 115A is fixed to an auger rotating shaft 115 and engages with the bevel gear 116A of the torque transmitting shaft 116. For this reason, driving force of the driving plate 108 is transmitted from the torque transmitting shaft 116, the bevel gear 116A, and the bevel gear 115A in this order to the auger rotating shaft 115 to rotate the auger.

Since the toner feeding tube 114 is made of a flexible semitransparent or transparent tube as mentioned above, there is less restriction on arrangement between the detachment portions 96, 98, 100 and 102 and the developing units 21, 23, 25 and 27. Further, because the toner feeding tube 114 can be formed by one tube, there is no need to use a plurality of members. Furthermore, it is possible to visually check whether or not toner remains in the tube after cleaning from outside.

Moreover, since the toner feeding tube 114 is disposed so that inclination between the initial point and the end point falls within ±20 degrees with respect to horizontal plane, in contrast to the case of excessive up-grade or down-grade of the toner feeding tube 114, a predetermined amount of toner can be transported stably without causing the following problems: clustered toner increases density, leading to increase in amount of emission; and the amount of toner to be transported cannot be controlled to be constant. Thus, there is no need to control rotation of the auger 105 for each of the detachment portions 96, 98, 100 and 102.

Each of small cylindrical or annular main body keys 99A, 99B, 99C and 99D, the circle of which is partially broken as shown in FIGS. 3 to 5, is provided at inlets of the detachment portions 96, 98, 100 and 102, respectively. At the detachment portion 96, the main body key 99A is fixed so that a notch is located at the upper left when viewed from front and at the detachment portion 98, the main body key 99B is fixed so that a notch is located at the lower right when viewed from front. At the detachment portion 100, the main body key 99C is fixed so that a notch is located at the bottom when viewed from front and at the detachment portion 98, the main body key 99B is fixed so that a notch is located at the top when viewed from front.

Figure 6:
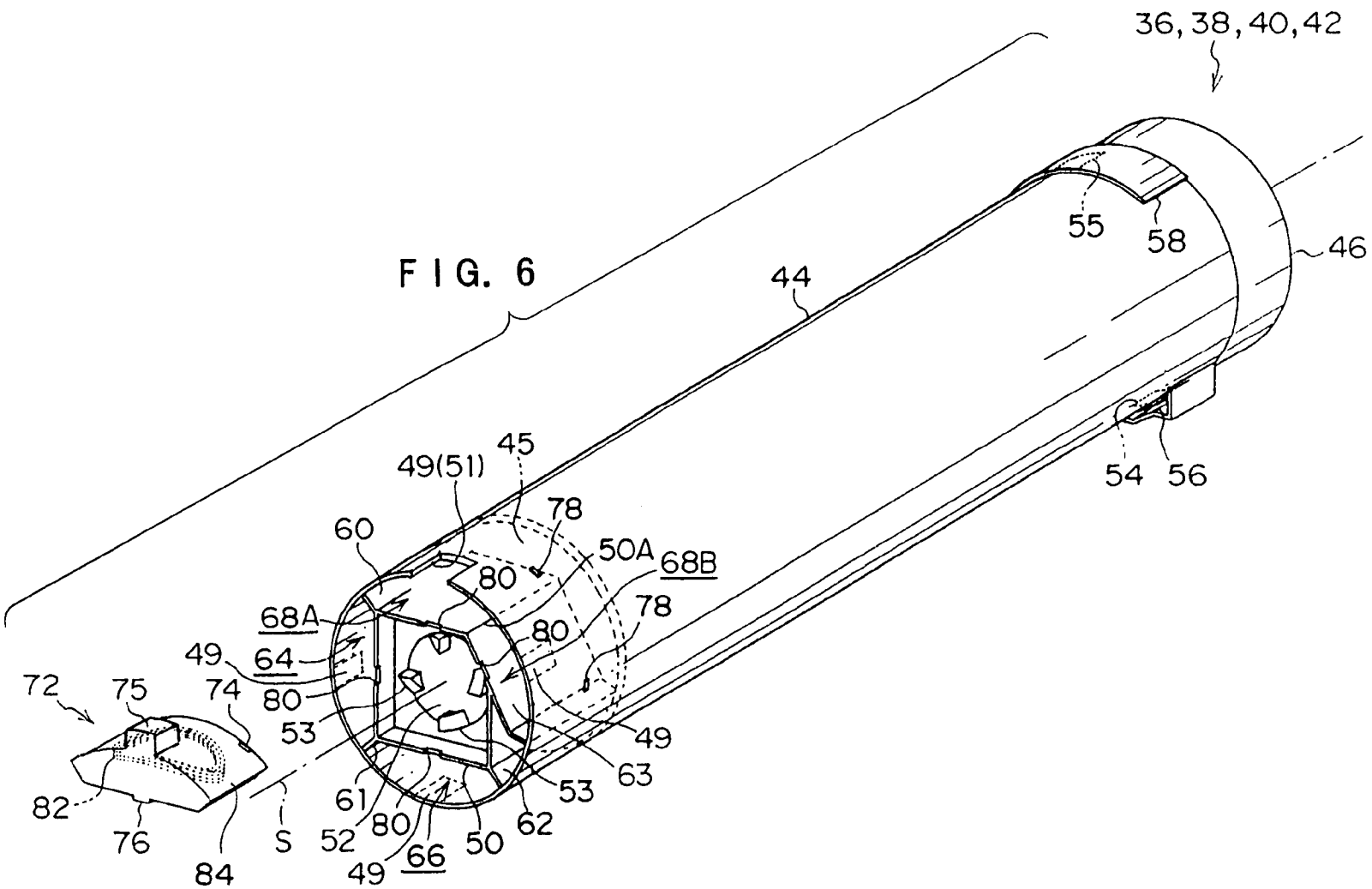
FIG. 6 is a perspective view showing the toner cartridge attached to the laser printer shown in FIG. 1 when viewed from the bottom.
Figure 7:
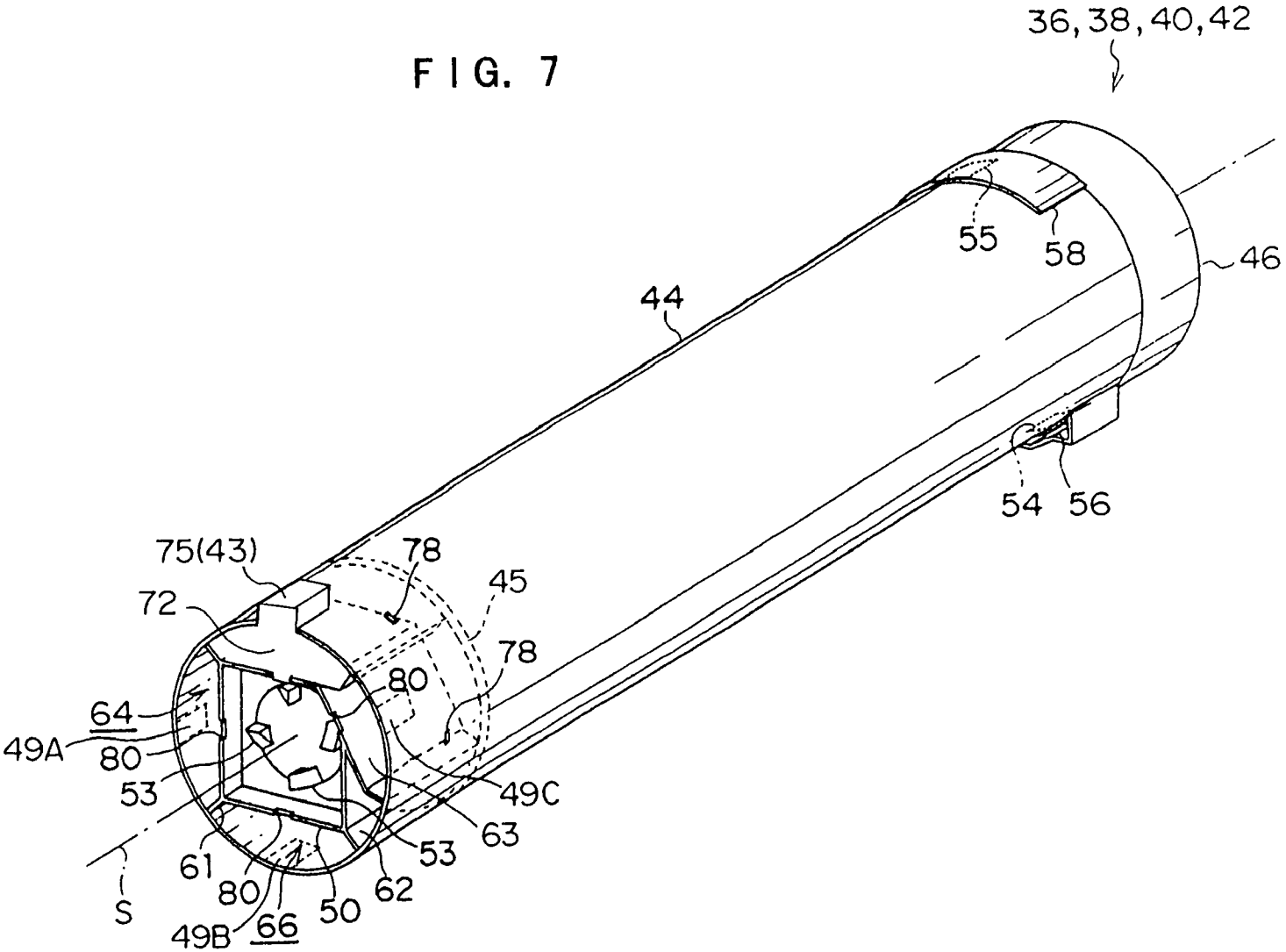
FIG. 7 is a perspective view showing the toner cartridge shown in FIG. 6, to which a wireless communication tag is attached.
Figure 8:
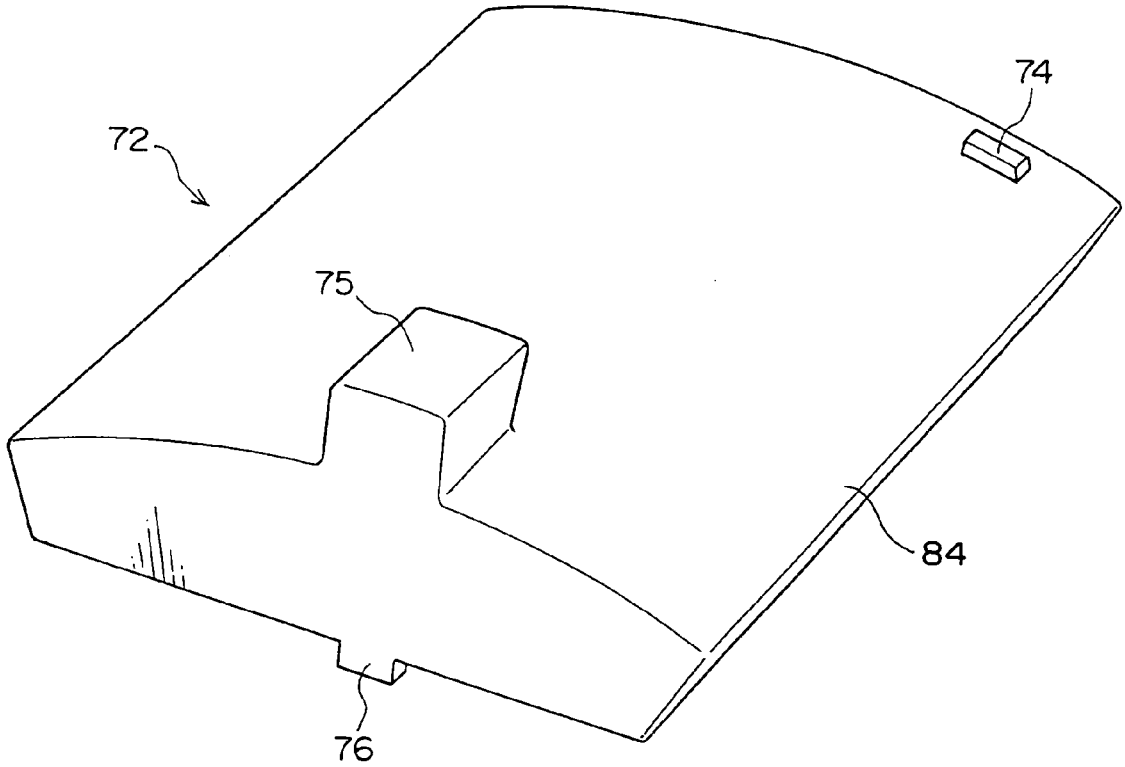
FIG. 8 is a perspective view showing the shape of the wireless communication tag.

As shown in FIG. 6, the toner cartridges 36, 38, 40 and 42 each have a cylindrical closed-end cartridge body 44. As shown in FIGS. 6 to 8, a cylindrical closed-end cap portion 46 having a base plate portion 47 is fitted into an opening of the cartridge body 44 to serve as a cap. As shown in FIG. 1, a plate-like handle portion 48 is formed integrally with the base plate portion 47 on the inside of the cap portion 46. As shown in FIG. 2, although the cap portions 46 of the toner cartridges 36, 40 and 42 have the same size in the thickness direction, the cap portion 46 of the toner cartridge 38 is smaller than the cap portions 46 of the toner cartridges 36, 40 and 42 in the thickness direction. As mentioned above, the detachment 98 to which the toner cartridge 38 is attached is disposed at the position protruding from the front edges of other detachment portions 96, 100 and 102. However, since the cap portion 46 of the toner cartridge 38 has a smaller size in the thickness direction, when the toner cartridges 36, 38, 40 and 42 are attached to the detachment portions 96, 98, 100 and 102, respectively, end faces of the cap portions 46 of the toner cartridges 36, 38, 40 and 42 are all in the same plane. This prevents the toner cartridges 36, 38, 40 and 42 from being attached to the detachment portions 96, 98, 100 and 102 in the state where the toner cartridges are not pushed as far as they will go.

As shown in FIG. 6, a toner feeding opening 54 and a toner filling opening 55 are opened in the vicinity of the opening of the surrounding wall of the cartridge body 44. The shutter member 56 slidable along the circumferential direction is disposed on the outer periphery of the toner feeding opening 54. The shutter member 56 is formed so as to slide between the blocked position at which the toner feeding opening 54 is blocked and the opened position at which the toner feeding opening 54 is opened, and urged to hold the blocked position by use of a powering member such as coil spring (not shown). Accordingly, when the toner cartridges 36, 38, 40 or 42 is not attached to the cartridge holder 34, the shutter member 56 is maintained to be in the blocked position. The toner filling opening 55 is blocked by the cap member 58 fixed on the outer periphery of the cartridge body 44.

As shown in FIG. 6, an inside wall 50 is provided in the center of the bottom portion of the cartridge body 44. On the inward side of the inside wall 50, the disk-like driven connecting plate 52 is provided rotatably along the axis line S of the cartridge body 44. Within the cartridge body 44, a screw feeder (not shown) for transporting toner in the shape of screw shaft is disposed on the same axis. One end of the screw feeder is pivotally supported by the base plate of the cartridge body 44 and the driven connecting plate 52 is fixed to the rotating shaft of the screw feeder. The driven connecting plate 52 has a plurality of engaging claws 53 formed integrally therewith along the circumferential direction and engages with the driving connecting plate 109 by the engaging claws 53 to rotate. When the driven connecting plate 52 rotates, the screw feeder also rotates in one united body.

Further, four lib-like partition plates 60, 61, 62 and 63 are formed between the inside wall 50 and the inside wall of the cartridge body 44 along the substantially radial direction. The partition plates 60, 61, 62 and 63 divide a circular space generated between the inside wall of the cartridge body 44 and the inside wall 50 into small spaces along the circumferential direction. As shown in FIG. 6, these small spaces are opened at the front end face of the cartridge body 44 and blocked by the base plate portion 45 of the cartridge body 44 on the side of rear end.

As shown in FIG. 6, in the cartridge body 44, storage chambers 64 and 66 for storing a below-mentioned wireless communication tag 72 therein are formed by the partition plates 60 and 61, and the partition plates 61 and 62, respectively. The small space between the partition plates 60 and 63 also constitutes a storage chamber 68 for storing one wireless communication tag 72 therein. As shown in FIG. 6, however, the storage chamber 68 is functionally divided into a storage portion 68A and a storage portion 68B at an edge part 50A of the inside wall 50 as a border and can store the wireless communication tag 72 selectively in either the storage portion 68A or 68B. Therefore, one wireless communication tag 72 is stored selectively in the storage chamber 64, storage chamber 66, storage portion 68A or storage portion 68B of the storage chamber 68. Attachment position varies along the circumferential direction depending on the selected storage chamber 64, storage chamber 66, storage portion 68A or storage portion 68B. The storage chambers 64 and 66 and the storage portions 68A and 68B correspond to a tag attachment portion in the cartridge of the invention.

As shown in FIGS. 6 and 7, the wireless communication tag 72 has a cross section in the shape of a fan when viewed from the axial direction, which corresponds to the storage chambers 64 and 66, and is stored and held in the storage chamber 64, storage chamber 66, storage portion 68A or storage portion 68B by being inserted thereto. The wireless communication tag 72 has a pair of retaining claws 74 protruding outwards at the end of the inserting side on the outer peripheral surface and an engaging projection 76 protruding toward the axis S at the end of the inlet side. On the other hand, on the peripheral wall of the cartridge body 44, retaining holes 78 corresponding to the retaining claws 74 of the wireless communication tag 72 are formed in each of the storage chamber 64, storage chamber 66, storage portion 68A, and storage portion 68B, and on the rear end face of the inner wall 50, an engaging recess 80 corresponding to the engaging projection 76 of the wireless communication tag 72 is formed in each of the storage chamber 64, storage chamber 66, storage portion 68A, and storage portion 68B.

Thus, when the wireless communication tag 72 is inserted into either of the storage chamber 64, storage chamber 66, storage portion 68A, or storage portion 68B, as shown in FIG. 7, the outer peripheral face of the wireless communication tag 72 is closely contacted with the inner peripheral face of the cartridge body 44, so that the pair of retaining claws 74 each are inserted into the pair of retaining holes 78 and the engaging projection 76 engages with the engaging recess 80. This ensures the restraint of the wireless communication tag 72 in the circumferential direction. Moreover, rattle along the circumferential direction can be surely prevented by engaging the engaging projection 76 with the engaging recess 80. At this time, the retaining claw 74 inserted into the retaining hole 78 cannot be pull out of the retaining hole 78 unless the wireless communication tag 72 itself is deformed elastically to the inside peripheral side. For this reason, the wireless communication tag 72 inserted into either of the storage chamber 64, storage chamber 66, storage portion 68A, or storage portion 68B is configured so as not to be easily removed from the cartridge body 44 without special jigs.

Figure 9:
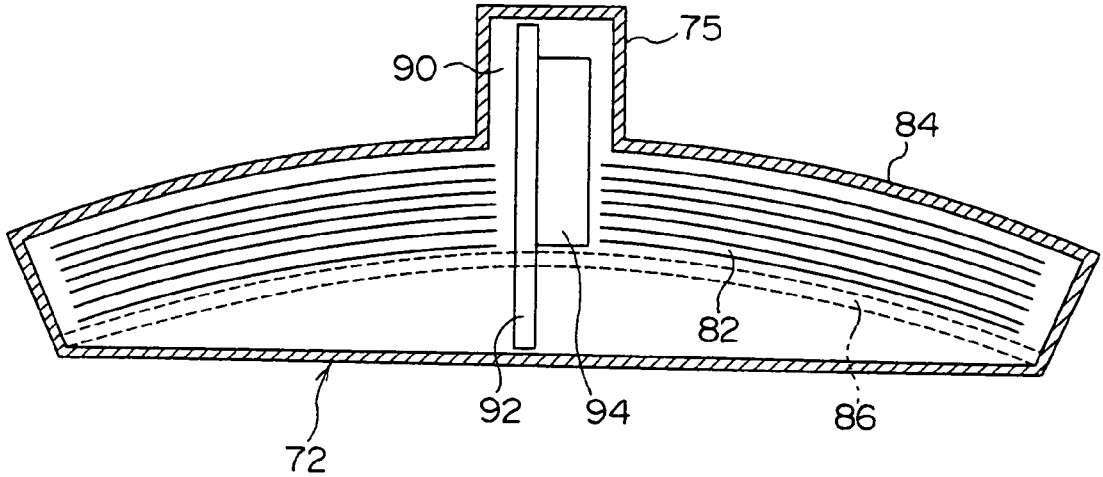
FIG. 9 is a cross sectional view showing an example of the internal configuration of the wireless communication tag.
Figure 13:
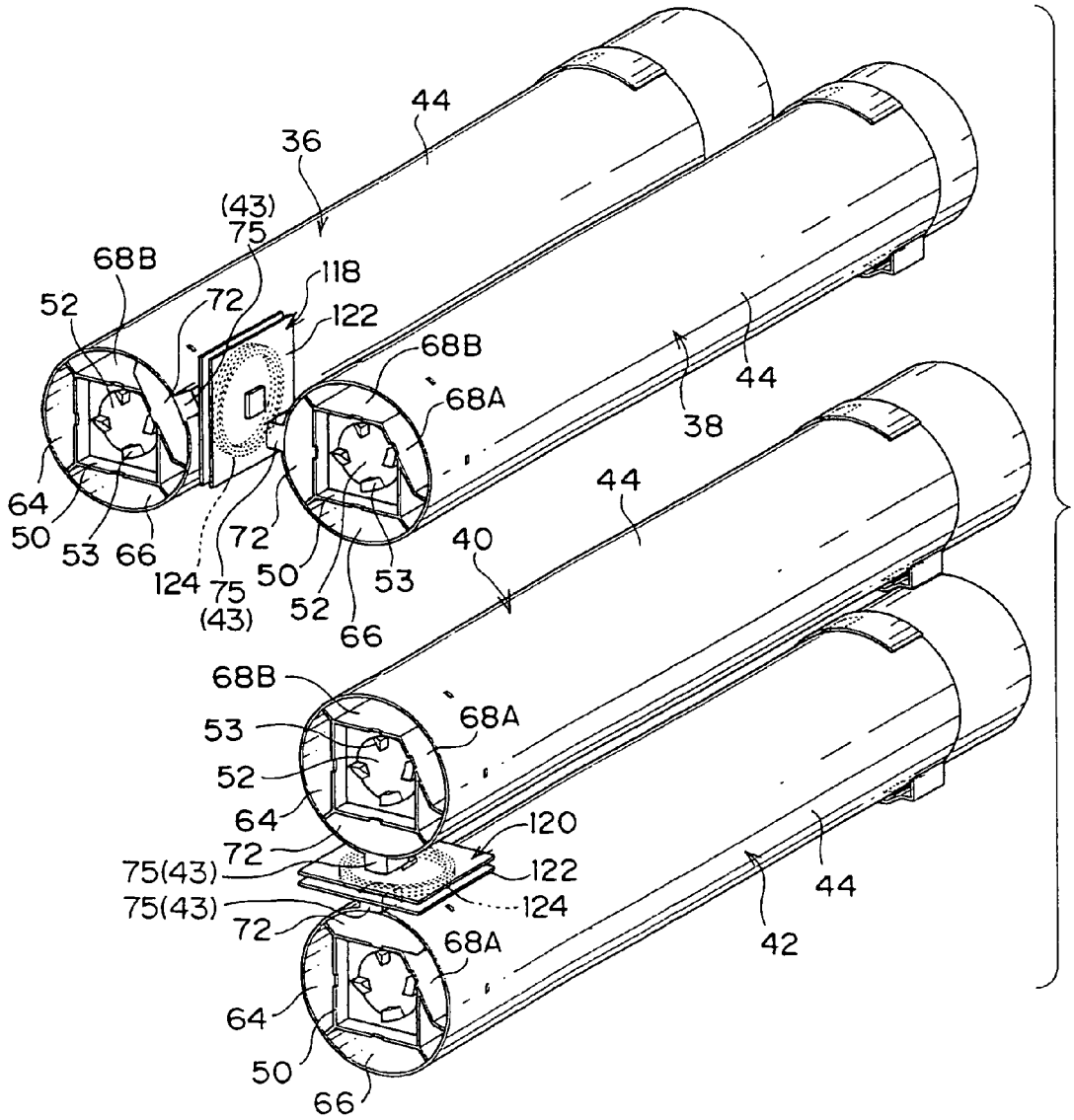
FIG. 13 is a perspective view showing relative physical relationship between a mechanical key protruding portion and an antenna unit provided with the laser printer when attaching the toner cartridge to which the wireless communication tag is attached to the laser printer.

As shown in FIGS. 6, 8, and 9, a mechanical key protruding portion 75 protrudes from an outer wall 84, that is, the circular curved face of the wireless communication tag 72. On the other hand, four cutting portions 49 corresponding the storage chambers 64, 66, 68A and 68B are on the outer peripheral face of the cartridge body 44 are arranged at even intervals. The cutting portion 49 can be cut off, and as shown in FIG. 6, cut-off of the cutting portion 49 generates a notched portion 51 for letting out the mechanical key protruding portion 75 when the wireless communication tag 72 is attached. When the wireless communication tag 72 is inserted into the storage chamber 64, storage chamber 66, storage portion 68A, or storage portion 68B, the cutting portion 49 of the peripheral wall of the target storage chamber is cut off prior to attachment. As a result, as shown in FIG. 7, the mechanical key protruding portion 75 protrudes from the cartridge body 44 toward the direction of above, below, upper right or left to constitute a cartridge key 43. Accordingly, by attaching the wireless communication tag 72 to the toner cartridges 36, 38, 40 and 42 so that the mechanical key protruding portion 75 protrudes toward the direction corresponding to the direction of the notched portions of the main body keys 99A, 99B, 99C and 99D, it is possible to bring the direction of the notched portions of the main body keys 99A, 99B, 99C and 99D into correspondence with the protruding direction of the cartridge key 43 one by one. Therefore, in each of the detachment portions 96, 98, 100 and 102, since only one of the toner cartridges 36, 38, 40 and 42 in which the direction of the notched portions of the main body keys 99A, 99B, 99C and 99D corresponds to the protruding direction of the cartridge key 43 can be attached, incorrect attachment of the toner cartridges 36, 38, 40 and 42 never causes. As shown in FIG. 13, in the laser printer 10, the toner cartridges 36, 38, 40 and 42 each are attached so that the cartridge key 43 points to the upper right, left, below and above, respectively, when viewed from the bottom of the cartridge body 44. The cartridge key 43 corresponds to an identification key in the cartridge of the invention.

Figure 10:
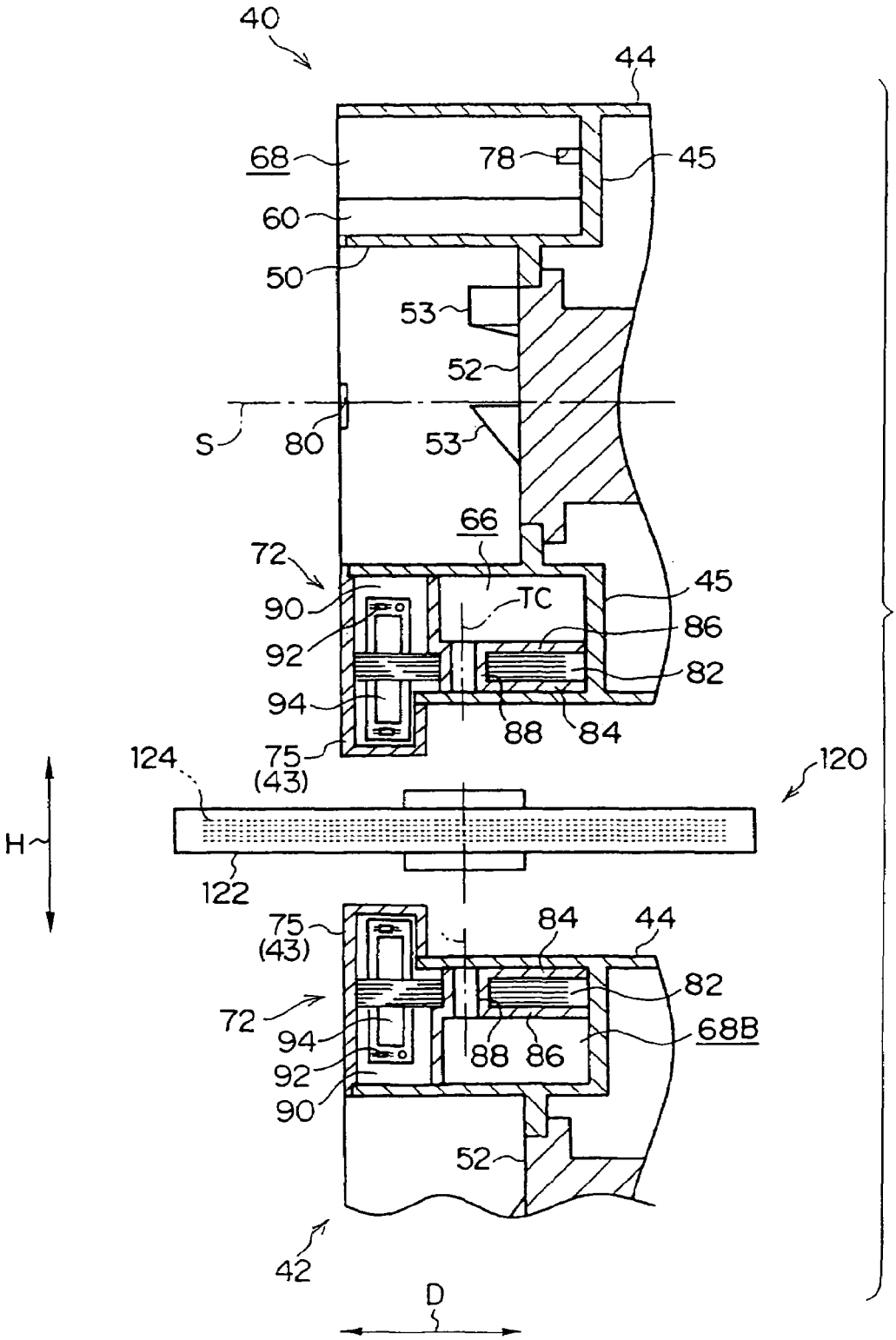
FIG. 10 is a cross sectional view showing a cross section along the axial direction of the toner cartridge to which the wireless communication tag is attached.
Figure 11:
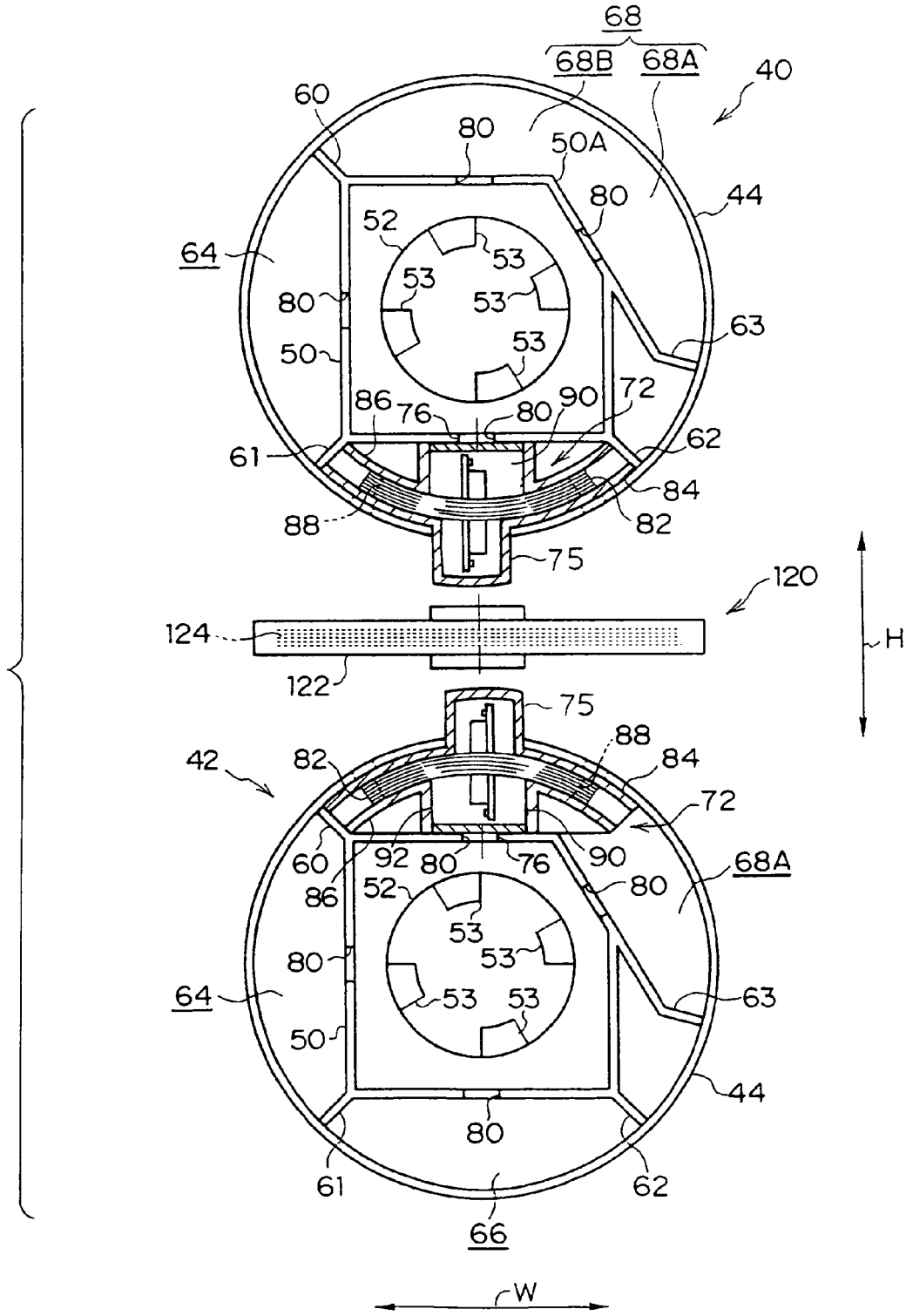
FIG. 11 is a cross sectional view showing a cross section along the radial direction of the toner cartridge to which the wireless communication tag is attached.

As shown in FIGS. 9 to 11, a tag antenna 82 formed by winding conductive wire such as copper wire in the shape of a coil is provided in the wireless communication tag 72. The tag antenna 82 is provided so that a coil axis TC as a core of the conductive wire is parallel to the thickness direction of the wireless communication tag 72 and the coil face along the direction perpendicular to the axis curves along the outer periphery of the wireless communication tag 72. Specifically, as shown in FIGS. 10 and 11, an outer wall part 84 and an inner wall part 86 that curve in parallel to each other are provided in the wireless communication tag 72 and a core portion 88 connects the outer wall part 84 to the inner wall part 86. By winding conductive wire around the outer periphery of the core portion 88, the flat tag antenna 82 which is flat along the axis direction is configured so as to curve along the outer peripheral face of the wireless communication tag 72.

The mechanical key protruding portion 75 forms a hollow compartment portion 90 that connects with space on the inner side of the tag antenna 82 and is sealed from outside. The compartment portion 90 contains a circuit board 92 therein and an IC chip 94 in which a control circuit of the wireless communication tag 72 is integrated as one chip is mounted on the circuit board 92. The IC chip 94 is electrically connected to the tag antenna 82 through the circuit board 92 and so on. Therefore, when the mechanical key protruding portion 75 is removed, the circuit board 92 is also cut and the IC chip 94 is destroyed, resulting in that the wireless communication tag 72 cannot exchange necessary information with the laser printer 10. Even if the toner cartridges 36, 38, 40 and 42 to which such wireless communication tag 72 is attached are installed, the laser printer 10 are not activated. Therefore, it is possible to prevent troubles such as failure and degradation in image quality of the laser printer 10 due to attachment of the non-genuine toner cartridges 36, 38, 40 and 42.

Figure 12:
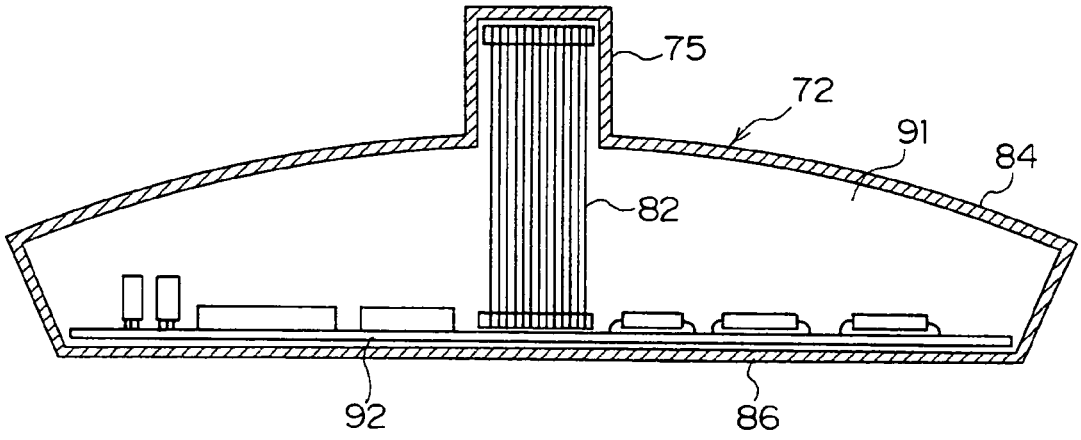
FIG. 12 is a cross sectional view showing an example of the internal configuration of the wireless communication tag.

As mentioned above, In the wireless communication tag 72, the circuit board 92 is contained in the mechanical key protruding portion 75. Alternatively, as shown in FIG. 12, the antennae 82 can be contained. In the wireless communication tag 72 as shown FIG. 12, an internal space 91 having a fan-like cross section between the outer wall part 84 and the internal wall part 86. The circuit board 92 is fixed on the internal wall part 86 and the antenna 82 is vertically arranged at the circuit board 92. Similarly, the mechanical key protruding portion 75 is formed to be hollow and constitutes a part of the internal space 91. A part of the antenna 82 is housed within the mechanical key protruding portion 75. Therefore, when the mechanical key protruding portion 75 is removed, the antenna 82 is also cut and destroyed, resulting in that the wireless communication tag 72 cannot exchange necessary information with the laser printer 10. As a result, even if the wireless communication tag 72 as shown FIG. 12 is used, it is possible to prevent troubles such as failure and degradation in image quality of the laser printer 10 due to attachment of the non-genuine toner cartridges 36, 38, 40 and 42.

As shown in FIGS. 2, 10, 11 and 13, in the toner cartridge 34, plate-like antenna units 118 and 120 each of which are placed at the back of the device between the detachment portions 96 and 98, and between the detachment portions 100 and 102, respectively. The antenna units 118 and 120 each have a resin casing part 122 in the shape of a thin plate and a coil-like main body antenna 124 formed by winding conductive wire such as copper wire is placed in the casing part 122. In the antenna units 118 and 120, the coil axis is parallel to the thickness direction of the casing part 122 and front and rear faces (coil faces) along the direction perpendicular to the axis are parallel to the face direction of the casing part 122. The antenna unit 118 disposed in the top layer of the cartridge holder 34 is supported so that the face direction is orthogonal to the width direction of the device (the direction of an arrow W) and the antenna unit 120 disposed between the intermediate layer and the bottom layer of the cartridge holder 34 is supported so that the face direction is orthogonal to the height direction of the device (the direction of an arrow H).

As shown in FIG. 13, in the state where the toner cartridges 36, 38, 40 and 42 are attached to the cartridge holder 34, the upper antenna unit 118 is supported so as to be inserted into a gap formed between formed the toner cartridges 36 and 38 along the width direction of the device and the lower antenna unit 120 is supported so as to be inserted into a gap formed between formed the toner cartridges 40 and 42 along the height direction H of the device. Here, in the cartridge holder 34, the toner cartridge 36 is attached in the second row at the side further to developing unit 21, 23, 25 and 27 and the toner cartridge 38 is attached to the top layer of the first row at the side closer to the developing unit 21, 23, 25 and 27. The toner cartridge 40 and the toner cartridge 42 are attached to the intermediate and bottom layer of the first row, respectively. Therefore, the antenna unit 118 is an antenna located between two toner cartridges adjacent to each other in the first row and the second row, and the antenna unit 120 is an antenna located between remaining two toner cartridges in the first row.

On the other hand, in the cartridge holder 34, in the toner cartridge 36 attached to the detachment portion 96, the wireless communication tag 72 is inserted into the storage portion 68A of the storage chamber 68, and in the toner cartridge 38 attached to the detachment portion 98, the wireless communication tag 72 is inserted into the storage chamber 64. Thus, the coil face of the tag antenna 82 in the toner cartridge 36 and one coil face of the main body antenna 124 along the thickness direction are faced and sufficiently close to each other, and the coil face of the tag antenna 82 in the toner cartridge 38 and the other coil face of the main body antenna 124 along the thickness direction are faced and sufficiently close to each other.

In the cartridge holder 34, in the toner cartridge 40 attached to the detachment portion 100, the wireless communication tag 72 is inserted into the storage chamber 66, and in the toner cartridge 42 attached to the detachment portion 102, the wireless communication tag 72 is inserted into the storage portion 68B of the storage chamber 68. Thus, the coil face of the tag antenna 82 in the toner cartridge 40 and the upper coil face of the main body antenna 124 are faced and sufficiently close to each other, and the coil face of the tag antenna 82 in the toner cartridge 42 and the lower coil face of the main body antenna 124 are faced and sufficiently close to each other.

Generally, as the distance between the tag antenna 82 and the main body antenna 124 becomes shorter, efficiency of transmission/reception of radio wave between the antennas becomes better, and as the tag antenna 82 and the main body antenna 124 are located coaxially, the efficiency becomes better. In the laser printer 10, the tag antenna 82 attached to the toner cartridges 38, 40 and 42 is supported coaxially with the main body antenna 124 and can perform transmission/reception of radio wave with the main body antenna 124 at the substantially highest efficiency, providing that the distance between the antennas is constant. The tag antenna 82 attached to the toner cartridge 36 is supported at a certain angle (about 20°) with respect to the main body antenna 124. However, because of a very small distance from the main body antenna 124, the tag antenna 82 attached to the toner cartridge 36 can perform transmission/reception of radio wave with the main body antenna 124 at a sufficiently high efficiency. In other words, when the output of radio wave used between the wireless communication tag 72 and a wireless communication device 130 (shown in FIG. 14) on the main body is made small enough, it becomes possible to surely prevent electrical interference of the wireless communication tag 72 that does not establish communication with the main body antenna 124 while maintaining good wireless communication. Here, the wireless communication device 130 and the antenna units 118 and 120 correspond to a communication control part of the image forming device of the invention.

For example, when the toner cartridge 38, 40 or 42 in place of the toner cartridge 36 that should be attached is attached to the detachment portion 96, the wireless communication tag 72 is not located at the position opposed to the antenna unit 118 and therefore the main body antenna 124 of the antenna unit 118 cannot receive radio wave from the wireless communication tag 72. This also applies to the detachment portions 98, 100 and 102. In this way, when an incorrect toner cartridge is attached to the detachment portion 96, 98, 100 or 102, both of the antenna units 118 and 120 cannot receive radio wave from the wireless communication tag 72 attached to this toner cartridge. Accordingly, it is possible to detect whether or not a correct toner cartridge is attached to the detachment portions 96, 98, 100 and 102 based on whether or not the antenna units 118 and 120 have received radio wave from the wireless communication tag 72 and to issue an alarm automatically when an incorrect toner cartridge is attached.

In the laser printer 10, when the toner cartridges 36, 38, 40 and 42 are attached to the respective detachment portions 96, 98, 100 and 102 in the cartridge holder 34, the toner cartridges 36, 38, 40 and 42 are firstly inserted into the back of the device in the depth direction until their front end hit the driving plate 108. Accordingly, the front ends of the toner cartridges 36, 38, 40 and 42 are connected to and supported by the driving plate 108 and the shutter engaging portion of the supporting bracket 106 engages with the shutter member 56 of the toner cartridges 36, 38, 40 and 42.

Next, by rotating the toner cartridges 36, 38, 40 and 42 at a predetermined angle in clockwise direction with the handle portion 48, the toner cartridges 36, 38, 40 and 42 are fully attached to the detachment portions 96, 98, 100, and 102, respectively. At this time, the driving connecting plate disposed at the driving plate 108 engages with the driven connecting plate 52 of the toner cartridges 36, 38, 40 and 42 and a driving motor built in the driving plate 108 is connected to the screw holder in the toner cartridges 36, 38, 40 and 42 so as to be capable of transmitting torque via the driving connecting plate and the driven connecting plate 52. Working with rotation of the detachment portions 96, 98, 100 and 102 of the toner cartridges 36, 38, 40 and 42, the shutter member 56 of the toner cartridges 36, 38, 40 and 42 slides from the blocked position to the opened position by the shutter engaging portion of the supporting bracket 106 to open the toner feeding openings 54.

In the laser printer 10, during operation of the developing units 21, 23, 25 and 27, the driving motor built in the driving plate 108 corresponding to the operating developing unit 21,23, 25 or 27 is rotated. Subsequently, the toner cartridges 36, 38, 40 and 42 discharge toner from the toner feeding opening 54 at a predetermined rate by the action of the screw feeder and the toner is fed to the operating developing unit 21,23, 25 or 27 through the toner feeding tube 114. At this time, the amount of toner fed to the developing unit 21,23, 25 or 27 is set to be almost equal to the amount of toner consumed for development.

The toner cartridges 36, 38, 40 and 42 attached to the cartridge holder 34 is configured as a casing for storing toner temporarily. In other words, in the laser printer 10, during operation of the developing units 21, 23, 25 and 27, toner is discharged from the toner cartridges 36, 38, 40 and 42 and the toner is fed to the developing unit 21, 23, 25 and 27, and when all of the toner filled in the toner cartridges 36, 38, 40 and 42 is discharged, the toner filled in the toner cartridges 36, 38, 40 and 42 are replaced with new ones. At this time, since toner is sealed in the toner cartridges 36, 38, 40 and 42 closely, refilling of toner to the laser printer 10 can be done easily and contamination inside and outside of the device due to splash of toner during refilling can be prevented effectively.

(Configuration and Operation of Wireless Communication System)

Next, configuration and operation of the wireless communication system in the laser printer configured as mentioned above will be described.

Figure 14:
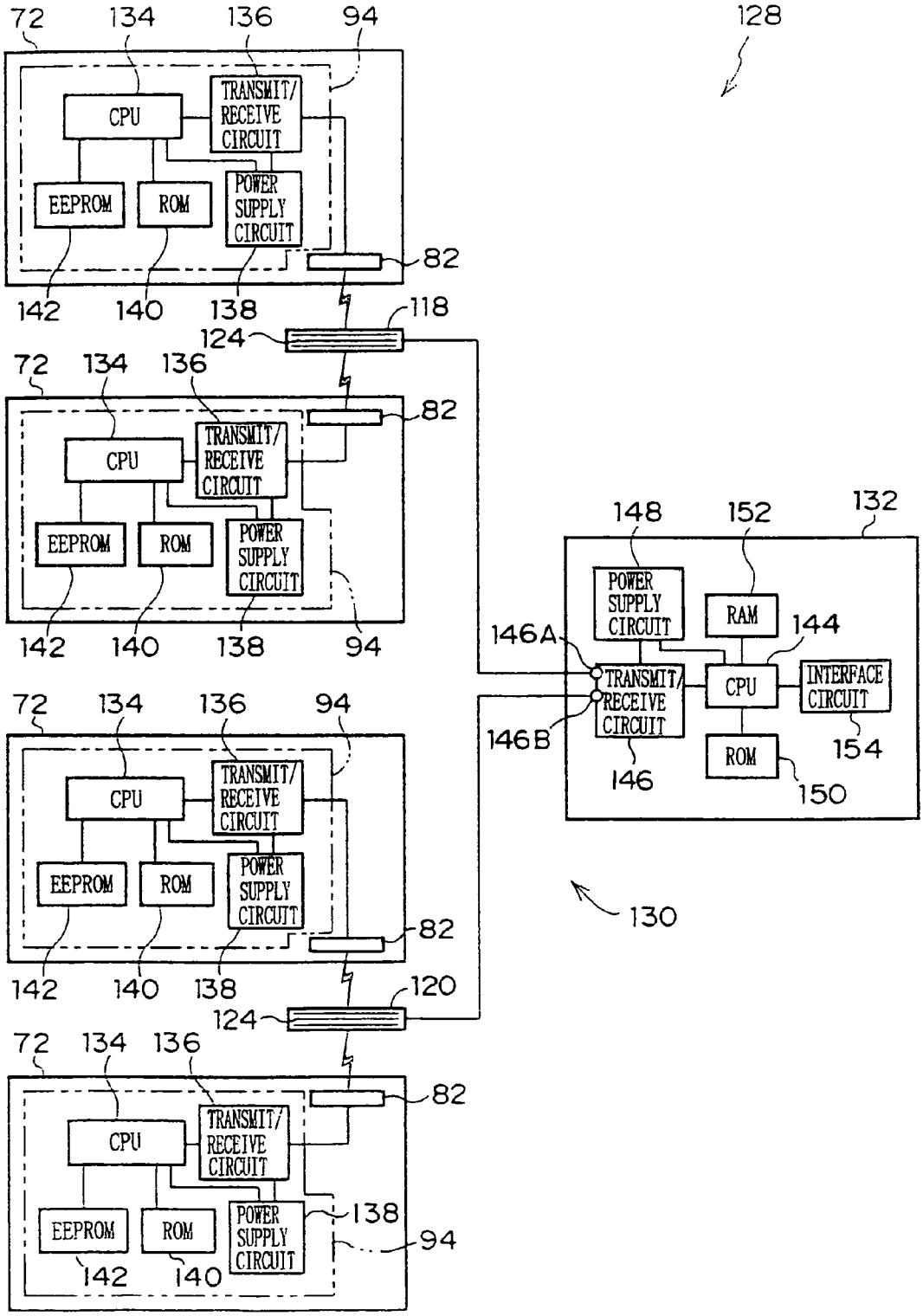
FIG. 14 is a block diagram showing the schematic configuration of a wireless communication system comprised of the wireless communication tag and a wireless communication device of the main body.

FIG. 14 is a block diagram showing configuration of the wireless communication system in accordance with the embodiment of the invention. This wireless communication system 128 is comprised of the wireless communication tags 72 attached to four toner cartridges 36, 38, 40 and 42, respectively, and the wireless communication device 130 on the main body. The wireless communication device 130 has two antenna units 118 and 120 disposed in the cartridge holder 34 and a main body part 132 connected to the main body antenna 124 built in each of the antenna units 118 and 120.

As mentioned above, the wireless communication tag 72 attached to each of the toner cartridges 36, 38, 40 and 42 has the tag antenna 82 on the coil and the IC chip 94 mounted on the circuit board 92. As shown in FIG. 7, the IC chip 94 is configured as a single device in which a CPU 134, a transmit/receive circuit 136, a power supply circuit 138, a ROM 140 and an EEPROM 142 are integrated. The CPU 134 controls the entire wireless communication tag 72 according to a control program stored in the ROM 140. The ROM 140 stores multi ID, password and system ID as specific information corresponding to the types of the toner cartridges 36, 38, 40 and 42 in addition to the control program. Basically, the multi ID is predetermined data corresponding to the types of the toner cartridges 36, 38, 40 and 42, and the password and system ID are data for confirming the wireless communication tag 72 is allowed to exchange information with the wireless communication device 130.

On the other hand, the EEPROM 142 is a nonvolatile information storage device requiring no electric power for holding storage information that can write arbitrary information therein by the CPU 134 and read out arbitrary information from the written information. Specifically, the EEPROM 142 writes, for example, the following information therein by the CPU 134 and updates the written information as necessary:

(1) Process information such as exposure amount, charged amount and developing bias to the photosensitive drums 20, 22, 24 and 26;

(2) Lot number, manufacturing date, type, shelf life, identification number, the number of recycle, upper limit of the number of recycle and replacement date of cartridge components; and (3) Lot number, manufacturing date, filled amount, type, shelf life, the number of recycle and upper limit of the number of recycle of toner.

However, since the toner cartridges 36, 38, 40 and 42 can be identified by the protruding direction of the cartridge key 43, common information may be written in the CPU 134.

At transmission of information, the transmit/receive circuit 136 converts a parallel information signal sent from the CPU 134 into a serial information signal and then outputs an electrical signal modulated by this information signal to the tag antenna 82. Thus, the tag antenna 82 outputs (emits) an electric wave signal corresponding to the information signal sent from the CPU 134. At reception of information, the transmit/receive circuit 136 demodulates the electrical signal obtained by the electric wave signal received from the tag antenna 82 to a serial information signal and then converts the information signal to a parallel information signal to output to the CPU 134.

At transmission or reception of information with the wireless communication device 130, the power supply circuit 138 in the wireless communication tag 72 separates an AC current of a predetermined frequency generated in the tag antenna 82 by electromagnetic induction from the information signal and converts the AC current to a DC current and then supplies the DC current to the CPU 134 and the transmit/receive circuit 136. As a result, the CPU 134 and the transmit/receive circuit 136 receive electrical power necessary for transmission or reception with the wireless communication device 130 and the wireless communication tag 72 requires no power supply such as cell and battery.

As shown in FIG. 14, the main body of the wireless communication device 130 has a CPU 144, a transmit/receive circuit 146, a power supply circuit 148, a ROM 150, a RAM 152 and an interface circuit 154. The transmit/receive circuit 146 has two input/output terminals 146A and 146B for each antenna, and one input/output terminal 146A is connected to the main body antenna 124 of the antenna unit 118 and the other input/output terminal 146B is connected to the main body antenna 124 of the antenna unit 120. At transmission or reception of information with the wireless communication tag 72, the transmit/receive circuit 146 turns on one of the input/output terminals 146A and 146B and turns off the other input/output terminal depending on target that information is input or output.

The CPU 144 controls the entire wireless communication device 130 according to a control program stored in the ROM 150. The ROM 150 stores multi ID, password and system ID of all toner cartridges 36, 38, 40 and 42 in addition to the control program. By comparing the multi ID and password input from the wireless communication tag 72 with the multi ID and password stored in the ROM 150, the CPU 144 identifies the type of the toner cartridges 36, 38, 40 and 42 to which the wireless communication tag 72 during transmission of electric wave is attached and confirms the wireless communication tag 72 is allowed to exchange information with the wireless communication device 130.

The CPU 144 allows process information such as exposure amount, charged amount and developing bias of the toner cartridges 36, 38, 40 and 42 to the photosensitive drums 20, 22, 24 and 26, which is sent from a central control unit (not shown) of the laser printer 10 via the interface circuit 154, as well as written information such as consumed amount of toner calculated based on the process information to be temporarily stored in the RAM 152, and then reads out transmission information from the RAM 152 at a predetermined timing and sends the information to the wireless communication tag 72. Subsequently, the CPU 134 of the wireless communication tag 72 writes the written information received from the wireless communication device 130 into the EEPROM 142 and records residual amount of toner obtained by subtracting consumed amount from filled amount of toner on the EEPROM 142.

At transmission of information, the transmit/receive circuit 146 in the main body converts a parallel information signal sent from the CPU 144 into a serial information signal and then outputs an electrical signal modulated by this information signal to either of two main body antennas 124. Thus, the main body antenna 124 outputs (emits) an electric wave signal corresponding to the information signal sent from the CPU 144. At reception of information, the transmit/receive circuit 146 demodulates the electrical signal obtained by the electric wave signal received from the main body antenna 124 to a serial information signal and then converts the information signal to a parallel information signal to output to the CPU 144.

During communication with the wireless communication tag 72, the power supply circuit 148 of the main body supplies an AC current at a predetermined frequency to the main body antenna 124. As a result, electromagnetic induction generates in the tag antenna 82 opposed to the main body antenna 124 and as mentioned above, electrical power is fed to the wireless communication tag 72. Here, frequency of the AC current supplied to the main body antenna 124 by the power supply circuit 148 is selected to have the same band width as the frequency of the electrical signal used for information transmission by the transmit/receive circuits 136 and 146 at transmission and to have the a different band width (for example, high frequency range) at reception.

When the CPU 144 of the main body determines that all toner has been discharged from the toner cartridge 36, 38, 40 or 42, the CPU 144 transmits a count-up signal to the wireless communication tag 72 attached to the toner cartridge 36, 38, 40 or 42, the CPU. The CPU 134 of the wireless communication tag 72 that receives the count-up signal adds "1" to the number of recycles of the toner cartridges 36, 38, 40 and 42 and the number of recycles of toner, which are written into the EEROM 142.

Figure 15:
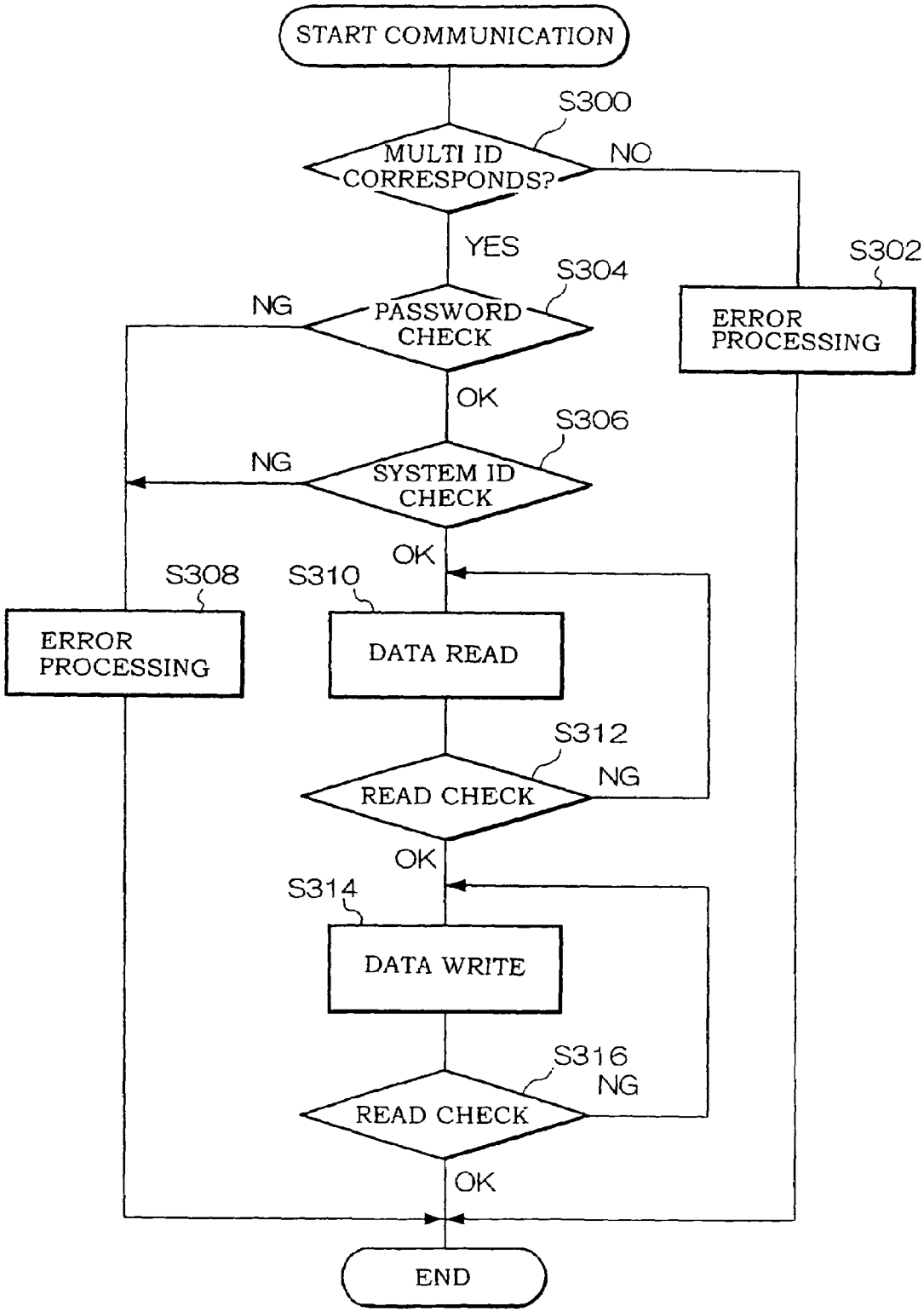
FIG. 15 is a flow chart showing a series of procedures of communication start processing in the wireless communication system.

FIG. 15 shows a series of procedures of communication start processing in the wireless communication system 128 in accordance with this embodiment. In the laser printer 10, in the case where power-on, replacement of the toner cartridges 36, 38, 40 and 42, and reset processing after occurrence of trouble such as jam are performed, the CPU 144 of the wireless communication device 130 carries out communication start processing.

In the wireless communication system 128, target to be communicated with the wireless communication device 130 is actually the wireless communication tag 72 attached to each of the toner cartridges 36, 38, 40 and 42. However, in the description concerning the flow chart of FIG. 15, in the case where there is no need to identify the target of wireless communication accurately, the target to be communicated with the wireless communication device 130 is described as "the toner cartridges 36, 38, 40 and 42" for simplified explanation.

In communication start processing, at a step 300, it is determined whether or not the multi ID (M) of the wireless communication device 130 corresponds with the multi ID (M) of the toner cartridge 36. At the step 300, when the multi ID (M) of the wireless communication device 130 corresponds with the multi ID (M) of the toner cartridge 36, it is determined that correct toner cartridge 36 is attached to the detachment portion 96 of the cartridge holder 34, the routine proceeds to a step 304 and the wireless communication device 130 starts communication with the toner cartridge 36. When the multi ID (M) of the wireless communication device 130 does not correspond with the multi ID (M) of the toner cartridge 36, the routine proceeds to a step 302 and it is determined that no toner cartridge is attached to the detachment portion 96 of the cartridge holder 34 or incorrect toner cartridge 36 is attached to the detachment portion 96 and the predetermined error processing is carried out.

At steps 304 to 306, password check and system ID check between the wireless communication device 130 and the toner cartridge 36 are performed in this order. At this time, when either of password or system ID of the toner cartridge 36 is determined to be incorrect, it is determined that incorrect toner cartridge 36 is attached to the detachment portion 96, the routine proceeds to a step 308 and the predetermined error processing is carried out. When both of password and system ID is determined to be correct, the routine proceeds to a step 310, and the CPU 144 of the wireless communication device 130 controls the wireless communication tag 72 of the toner cartridge 36 and reads out process information such as exposure amount, charged amount and developing bias to the photosensitive drums 20, 22, 24 and 26 as well as toner information such as filled amount, type and shelf life from the EEPROM 142.

At a step 312, the CPU 144 of the wireless communication device 130 performs read check for determining whether or not information read out from the EEPROM 142 corresponds with information written into the EEPROM 142 in the CPU 134 of the toner cartridge 36. When both information correspond with each other, the routine proceeds to a step 314, and when both information do not correspond with each other, the routine returns to the step 310 and the processing of reading out information from the EEPROM 142 is repeated until information read out from the EEPROM 142 corresponds with information written into the EEPROM 142.

At the step 314, the CPU 144 of the wireless communication device 130 transmits initial information including identification number unique to the laser printer 10, identification number unique to the user and usage start time of the toner cartridge 36 to the wireless communication tag 72 in the toner cartridge 36 and writes the initial information into the EEPROM 142 of the wireless communication tag 72. At a step 316, the CPU 144 of the wireless communication device 130 performs read check for determining whether or not the transmitted initial information is written into the EEPROM 142 without fault in the CPU 134 in the toner cartridge 36. When both information correspond with each other, communication start processing with the toner cartridge 36 is finished, and when both information do not correspond with each other, the routine returns to the step 314 and the processing of writing information into the EEPROM 142 is repeated until the initial information transmitted to the wireless communication tag 72 corresponds with information written into the EEPROM 142.

In the wireless communication system 128, when communication start processing with the toner cartridge 36 that contains M toner therein is finished, the basically same processing as a series of communication start processing as shown in FIG. 15 is carried out with the toner cartridges 38, 40 and 42 that Y, K and C toner, respectively, in a sequential order. After communication start processing between the wireless communication device 130 and all of the toner cartridges 36, 38, 40 and 42 is finished, the central control unit of the laser printer 10 releases interlock so that the operation of image forming can be started.

Further, every one or the predetermined number of image formation, the central control unit outputs process information and toner information such as consumed amount corresponding to the respective toner cartridges 36, 38, 40 and 42 to the CPU 144 through the interface circuit 154 of the wireless communication device 130. The CPU 144 transmits the information from the central control unit to the corresponding wireless communication tag 72 of the toner cartridges 36, 38, 40 and 42 and also writes the information from the central control unit into the EEPROM 142 of the wireless communication tag 72.

(Function of Embodiment)

Next, function of the laser printer 10 thus configured in accordance with this embodiment will be described.

In the wireless communication system 128 of the laser printer 10 in accordance with this embodiment, since the tag antenna 82 disposed at each of the toner cartridges 36, 38, 40 and 42 is supported by the toner cartridges 36, 38, 40 and 42 so that the coil axis TC is substantially orthogonal to the inserting direction with respect to the detachment portions 96, 98, 100 and 102, respectively, the tag antenna 82 need not to be disposed so as to cover end faces of the toner cartridges 36, 38, 40 and 42. Therefore, even if the cap portion 46 and the driven connecting plate 52 are disposed on the end faces of the toner cartridges 36, 38, 40 and 42, the wireless communication tag 72 can be attached to the toner cartridges 36, 38, 40 and 42 so as not to interference with these components.

Moreover, in the laser printer 10 in accordance with this embodiment, as mentioned above, in the toner cartridge 36, the protruding direction of the cartridge key 43 matches with the direction of notched portion of the main body key 99A placed at the detachment portion 96. Similarly, in the toner cartridge 38, the protruding direction of the cartridge key 43 matches with the direction of notched portion of the main body key 99B placed at the detachment portion 98, in the toner cartridge 40, the protruding direction of the cartridge key 43 matches with the direction of notched portion of the main body key 99C placed at the detachment portion 100 and in the toner cartridge 42, the protruding direction of the cartridge key 43 matches with the direction of notched portion of the main body key 99D placed at the detachment portion 102. Therefore, the toner cartridge 36 can be attached to only the detachment portion 96 and the toner cartridge 38 can be attached to only the detachment portion 98. Similarly, the toner cartridge 40 can be attached to only the detachment portion 100 and the toner cartridge 42 can be attached to only the detachment portion 102.

Further, in the wireless communication system 128, since the main body antenna 124 is disposed in the cartridge holder 34 so that the coil axis BC is substantially orthogonal to the inserting direction of the toner cartridges 36, 38, 40 and 42 to the detachment portions 96, 98, 100 and 102 and the coil face perpendicular to the coil axis BC is opposed to the coil face of the tag antenna 82, the main body antenna 124 need not to be disposed so as to be opposed to the end faces of the toner cartridges 36, 38, 40 and 42. Therefore, even if the components such as driven connecting plate is disposed so as to be opposed to the end faces of the toner cartridges 36, 38, 40 and 42, the main body antenna 124 can be easily disposed at the device so as not to interfere with the components.

Specifically, in the wireless communication system 128, since two main body antenna 124 are disposed at the gap generated between two toner cartridges 36 and 38 and the gap generated between two toner cartridges 40 and 42, respectively, the main body antenna 124 can be placed in the space that has not been used efficiently in the laser printer (dead space). Moreover, since the main body antenna 124 can be easily arranged to be opposed to the tag antenna 82 while being sufficiently close to the tag antenna 82, it is possible to efficiently place the main body antenna 124 in a narrow space of the main body and to ensure power supply and electrical communication due to electromagnetic induction between the wireless communication device 130 and the wireless communication tag 72 attached to each of the toner cartridges 36, 38, 40 and 42.

Furthermore, in the wireless communication system 128, the front face and the rear face of one main body antenna 124 each are opposed to the corresponding tag antenna 82, even if the main body antenna 124 is small-sized, specifically, substantially same size as the tag antenna 82, electromagnetic induction and transmission/reception of electric wave between one main body antenna 124 and two tag antennas 82 can be performed reliably.

2. Second Embodiment

Another embodiment of the toner cartridge used in the laser printer in accordance with the first embodiment will be described below.

Figure 16:
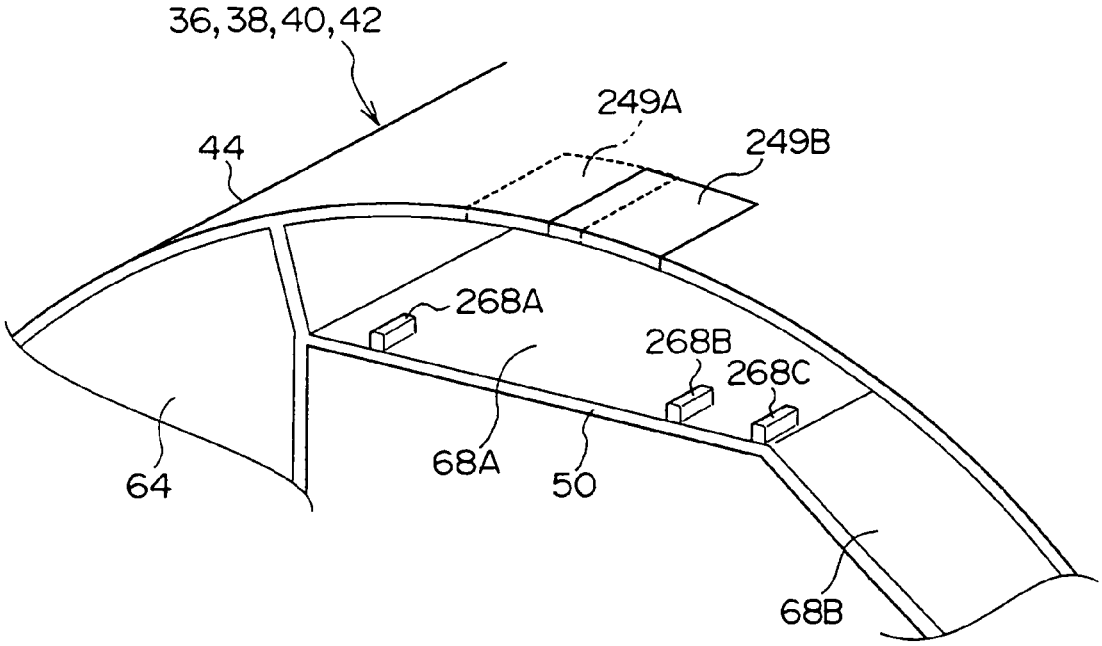
FIG. 16 is a perspective view showing the configuration of a toner cartridge in accordance with a second embodiment when viewed from the bottom.

In toner cartridges 36, 38, 40 and 42 in accordance with a second embodiment, as shown in FIG. 16, on the outer peripheral wall of the storage chamber 68A are provided a cutting portion 249A and a cutting portion 249B that are adjacent to each other with being partly overlapped. And, fixing ribs 268A, 268B and 268C for fixing a wireless communication tag 272 are formed on the inside wall 50 along the axis direction of the cartridge body 44.

Figure 17:
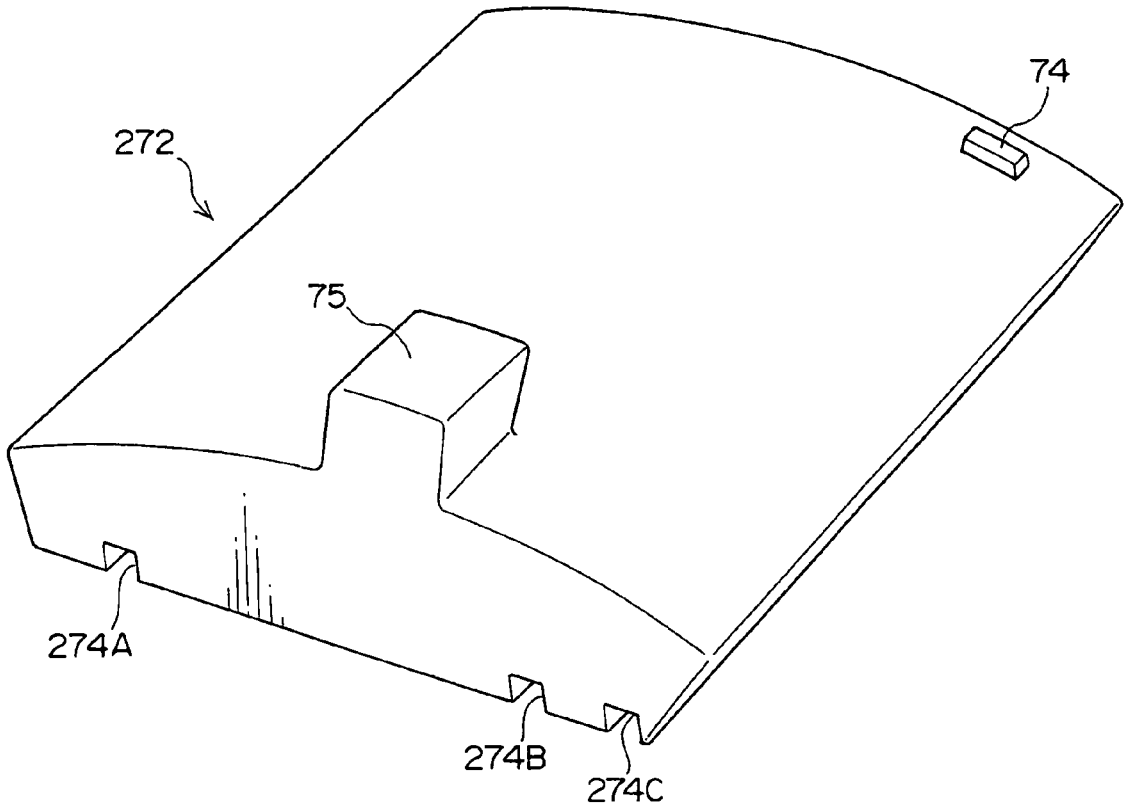
FIG. 17 is a perspective view showing a wireless communication tag attached to the toner cartridge shown in FIG. 16.

On the other hand, as shown in FIG. 17, recessed grooves 274A, 274B and 274C that engage with the fixing ribs 268A, 268B and 268C, respectively, are formed on the bottom face of the wireless communication tag 272 attached to the storage chamber 68A.

Figure 18:
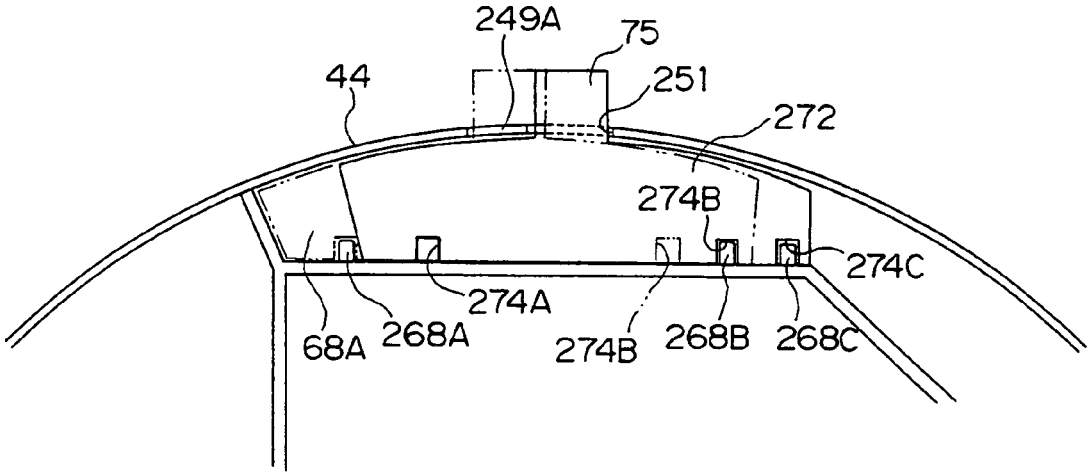
FIG. 18 is plan view showing the wireless communication tag shown in FIG. 17 stored into a storage chamber of the toner cartridge shown in FIG. 16.

When the wireless communication tag 272 is attached to the storage chamber 68A, as shown in FIG. 16, either the cutting portion 249A or the cutting portion 249B is cut off to form a notched portion 251 for letting out the mechanical key protruding portion 75 and as shown in FIG. 18, the recessed groove 274A and the recessed groove 274B or the recessed groove 274B and the recessed groove 274C engage with two of the fixing ribs 268A, 268B and 268C so as to engage therewith. In FIG. 18, a solid line indicates the inserted position of the wireless communication tag 272 when the cutting portion 249B is cut off and a chain double-dashed line indicates the inserted position of the wireless communication tag 272 when the cutting portion 249A is cut off. When the cutting portion 249B is cut off, as indicated by the solid line in FIG. 18, the wireless communication tag 272 is attached so that the recessed groove 274B and the recessed groove 274C engage with the fixing rib 268B and the fixing rib 268C, respectively. At this time, the fixing rib 268A comes in contact with the left side face of the wireless communication tag 272. On the other hand, when the cutting portion 249A is cut off, as indicated by the chain double-dashed line in FIG. 18, the wireless communication tag 272 is attached so that the recessed groove 274A and the recessed groove 274C engage with the fixing rib 268A and the fixing rib 268B, respectively. Here, as shown in FIGS. 16 to 18, since the fixing ribs 268A, 268B and 268C are arranged in the direction from left to right, a first attaching position of the wireless communication tag 272 wherein the wireless communication tag 72 is attached by removing the cutting portion 249A is on the left side of a second attaching position wherein the wireless communication tag 72 is attached by removing the cutting portion 249B.

Other than the above-mentioned points, configuration of the toner cartridges 36, 38, 40 and 42 and the wireless communication tag 272 is the same as that of the first embodiment.

In this manner, in the toner cartridges 36, 38, 40 and 42 in accordance with the second embodiment, the attaching position of the wireless communication tag 272 can be selected even in the same storage chamber 68A by selecting which of the cutting portion 249A or the cutting portion 249B is cut off, and therefore the position of the cartridge key 43 can be also selected. Accordingly, since, for example, color of toner contained in the toner cartridges 36, 38, 40 and 42 as well as information on what kind of laser printer the toner cartridges 36, 38, 40 and 42 should be attached to can be indicated by the position of the cartridge key 43, information to be recorded in the wireless communication tag 272 can be further shared.

3. Third Embodiment

Another embodiment of the toner cartridge used in the laser printer in accordance with the first embodiment and a wireless communication tag attached to the above-mentioned toner cartridge will be described below.

Figure 19:
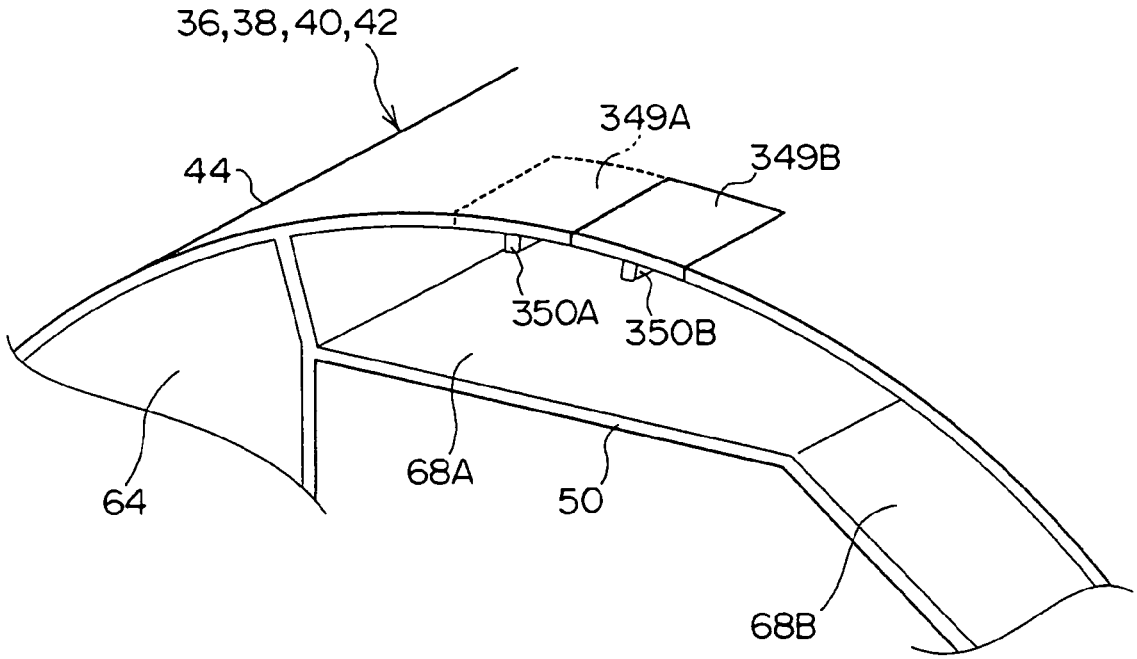
FIG. 19 is a perspective view showing the configuration of a toner cartridge in accordance with a third embodiment when viewed from the side of bottom face.

In toner cartridges 36, 38, 40 and 42 in accordance with a third embodiment, as shown in FIG. 19, on the outer peripheral wall of the storage chamber 68A are provided a cutting portion 349A and a cutting portion 349B that are adjacent to each other. The cutting portion 349A and the cutting portion 349B are provided with holding claws 350A and 350B, respectively, for holding an attached wireless communication tag 372 so as not to escape from the storage chamber 68A.

Figure 20:
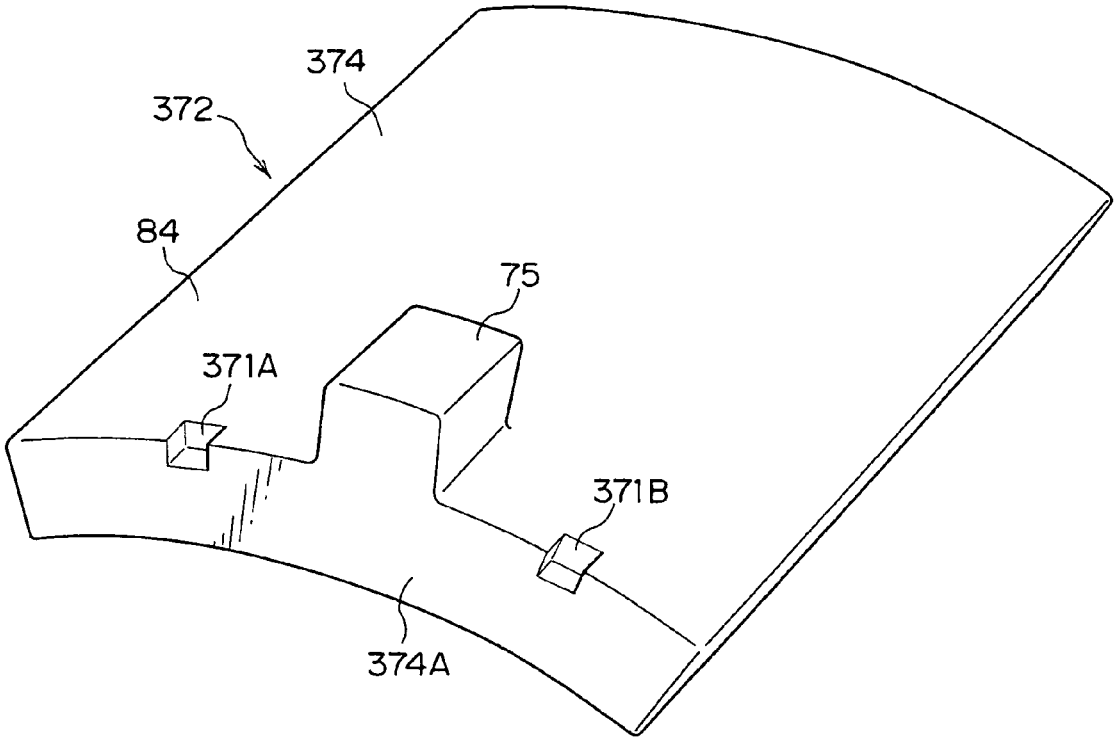
FIG. 20 is a perspective view showing the shape of a wireless communication tag attached to the toner cartridge shown in FIG. 19.

On the other hand, as shown in FIG. 20, in the wireless communication tag 372, the mechanical key protruding portion 75 protrudes from one end part on the outer wall part 84, that is, the circular curved face. Further, holding claw receiving parts 371A and 371B that engage with the holding claws 350A and 350B to lock the wireless communication tag 372 are formed on an upper border of a side board 374A so as to sandwich the mechanical key protruding portion 75 therebetween.

Figure 21:
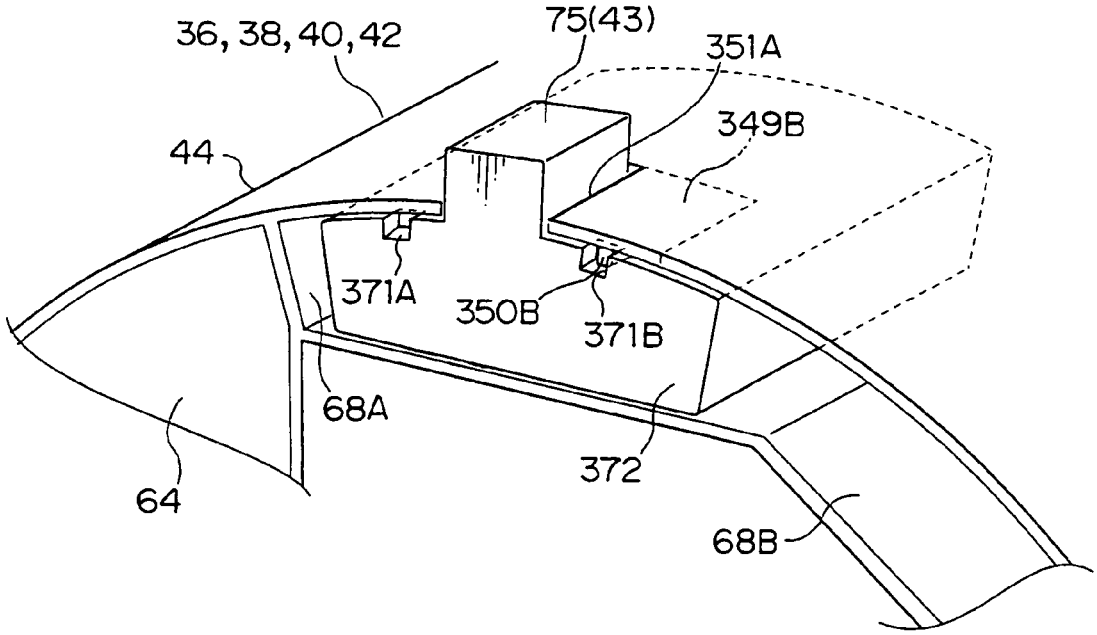
FIG. 21 is a perspective view showing the case where the wireless communication tag shown in FIG. 20 is attached to the toner cartridge shown in FIG. 19 by cutting off one of two cutting portions.
Figure 22:
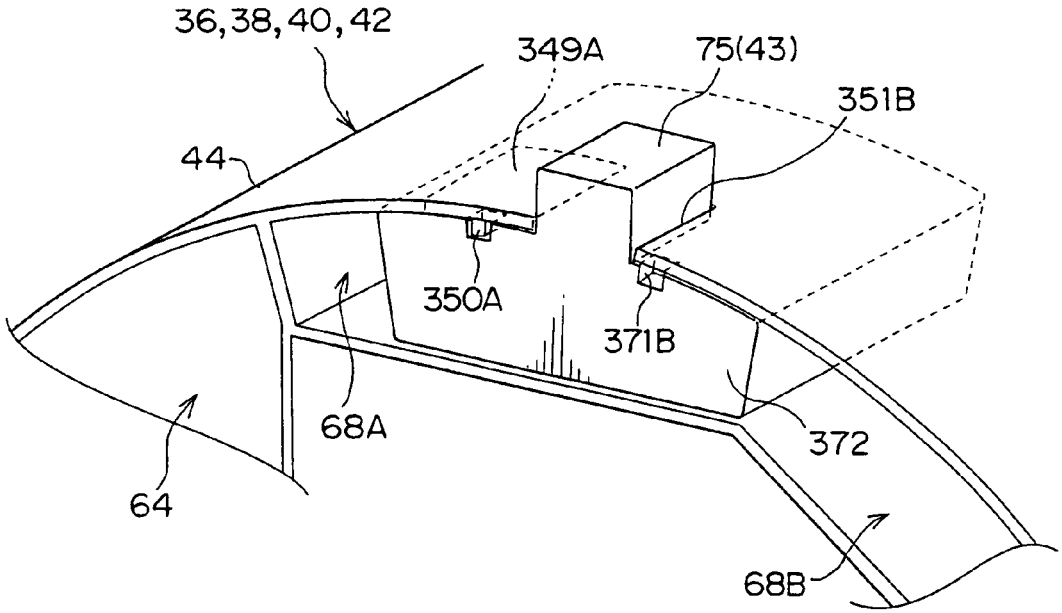
FIG. 22 is a perspective view showing the case where the wireless communication tag shown in FIG. 20 is attached to the toner cartridge shown in FIG. 19 by cutting off one of two cutting portions.

When the wireless communication tag 372 is attached to the storage chamber 68A of each of the toner cartridges 36, 38, 40 and 42, as shown in FIG. 21 and FIG. 22, either the cutting portion 349A or the cutting portion 349B is cut off. When the cutting portion 349A is cut off, as shown in FIG. 21, in the wireless communication tag 372, the mechanical key protruding portion 75 protrudes from a notched portion 351A formed by cutting off the cutting portion 349A and at the same time, the holding claw 350B of the remaining cutting portion 349B engages with the holding claw receiving part 371B to hold the wireless communication tag 372. On the other hand, when the cutting portion 349B is cut off, as shown in FIG. 22, in the wireless communication tag 372, the mechanical key protruding portion 75 protrudes from a notched portion 351B formed by cutting off the cutting portion 349B and at the same time, the holding claw 350A of the remaining cutting portion 349A engages with the holding claw receiving part 371A to hold the wireless communication tag 372.

In this manner, when either the cutting portion 349A or the cutting portion 349B is cut off, the remaining cutting portion holds the wireless communication tag 372.

Figure 23:
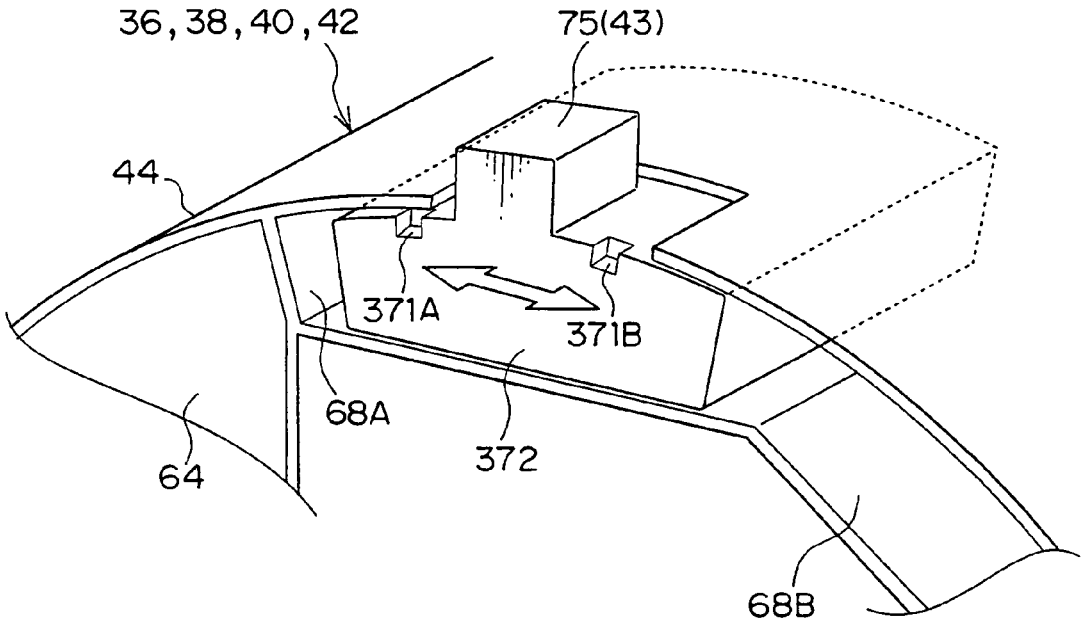
FIG. 23 shows state of the wireless communication tag when both of two cutting portions are cut off in the toner cartridge shown in FIG. 19.

However, both of the cutting portion 349A and the cutting portion 349B are cut off, as shown in FIG. 23, since there is no member that engages with either the holding claw receiving part 371A or the holding claw receiving part 371B to hold the wireless communication tag 372, the wireless communication tag 372 is not fixed within the storage chamber 68A and moves around freely. Therefore, since the wireless communication tag 372 cannot serve as an identification key, it is extremely difficult to collect an used one among the toner cartridges 36, 38, 40 and 42, fill toner of different color into the collected one and reattach the wireless communication tag 372 for recycling.

What is claimed is:

1. A cartridge detachably attached to an image forming device, to which an identification information tag that stores identification information for distinguishing the cartridge from other cartridge therein is attached, wherein an identification key that mechanically engages with the image forming device and distinguishes whether or not the cartridge can be attached is provided on the identification information tag.

2. A cartridge according to claim 1, wherein the identification key is a protruding portion that protrudes from the surface of the cartridge.

3. A cartridge according to claim 2, wherein the identification information tag is a non-contact communication tag that performs non-contact communication with the image forming device.

4. A cartridge according to claim 2, comprising a plurality of tag attachment portions to which an identification information tag of the same shape is attached, wherein the identification information tag is attached to one of the tag attachment portions.

5. A cartridge according to claim 3, comprising a plurality of tag attachment portions to which an identification information tag of the same shape, wherein the identification information tag is attached to one of the tag attachment portions.

6. A cartridge according to claim 4, wherein the tag attachment portion is formed so as to attach the identification information tag by cutting a specific area of a wall face forming the tag attachment portion.

7. A cartridge according to claim 5, wherein the tag attachment portion is formed so as to attach the identification information tag by cutting a specific area of a wall face forming the tag attachment portion.

8. A cartridge according to claim 6, wherein a notched portion to be cut for attachment of the identification information tag is formed at multiple positions on the wall face of the tag attachment portion, and the identification information tag cannot be fixed when the notched portion is cut at two positions or more.

9. A cartridge according to claim 7, wherein a notched portion to be cut for attachment of the identification information tag is formed at multiple positions on the wall face of the tag attachment portion, and the identification information tag cannot be fixed when the notched portion is cut at two positions or more.

10. A cartridge according to claim 1, wherein information to be stored in the identification information tag is shared between cartridges having the same function.

11. A cartridge detachably attached to an image forming device, comprising:

an identification information tag that stores identification information for distinguishing the cartridge from other cartridge therein, and an identification key as a protruding portion for mechanically distinguishing whether or not the cartridge can be attached at the side of the image forming device, wherein the identification information tag is provided in the identification key.

12. An identification information tag that is attached to a cartridge detachably attached to an image forming device and stores identification information for distinguishing the cartridge from other cartridge therein, wherein an identification key that mechanically engages with the image forming device and distinguishes whether or not the cartridge can be attached is provided.

13. The identification information tag of claim 12, wherein said identification information tag performs non-contact communication with the image forming device while being attached to the cartridge.

14. An identification information tag according to claim 12, wherein the identification key is a mechanical key protruding portion that protrudes from the surface of the cartridge when attached to the cartridge.

15. An identification information tag according to claim 14, wherein the mechanical key protruding portion is hollow.

16. An identification information tag according to claim 15, comprising an antenna and a circuit board for performing wireless communication with the image forming device, wherein at least a part of the antenna is disposed within the mechanical key protruding portion.

17. An identification information tag according to claim 15, comprising an antenna and a circuit board for performing wireless communication with the image forming device, wherein at least a part of the circuit board is disposed within the mechanical key protruding portion.

18. An image forming device comprising a cartridge attachment portion that attaches a cartridge to which an identification information tag that stores identification information for distinguishing the cartridge from other cartridge therein is attached, the identification information tag providing an identification key that mechanically engages with the image forming device and distinguishes whether or not the cartridge can be attached, wherein when the cartridge is attached to the cartridge attachment portion, the identification key provided on the identification information tag attached to the cartridge mechanically identifies whether or not the cartridge can be attached.

19. An image recording device according to claim 18, which is formed so as to perform non-contact communication with the identification information tag provided in the cartridge in the state where the cartridge is attached.

20. An image recording device as stated in claim 18, wherein information to be exchanged with the identification information tag is shared between cartridges having the same function.

* * * * *